US009653199B2

(12) United States Patent
Piascik et al.

(10) Patent No.: US 9,653,199 B2
(45) Date of Patent: May 16, 2017

(54) ELECTROMAGNETIC COIL ASSEMBLIES HAVING BRAIDED LEAD WIRES AND/OR BRAIDED SLEEVES

(71) Applicant: HONEYWELL INTERNATIONAL INC., Morristown, NJ (US)

(72) Inventors: James Piascik, Randolph, NJ (US); Eric Passman, Piscataway, NJ (US); Robert Franconi, New Hartford, CT (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 200 days.

(21) Appl. No.: 14/682,320

(22) Filed: Apr. 9, 2015

(65) Prior Publication Data

US 2015/0213929 A1 Jul. 30, 2015

Related U.S. Application Data

(62) Division of application No. 13/689,266, filed on Nov. 29, 2012, now Pat. No. 9,027,228.

(51) Int. Cl.
*H01F 27/02* (2006.01)
*H01F 5/04* (2006.01)
(Continued)

(52) U.S. Cl.
CPC ..... *H01F 5/04* (2013.01); *H01F 5/00* (2013.01); *H01F 5/06* (2013.01); *H01F 27/02* (2013.01);
(Continued)

(58) Field of Classification Search
CPC ..... H01F 27/00–27/30
(Continued)

(56) References Cited

U.S. PATENT DOCUMENTS 1,722,362 A 7/1929 Wiley
1,742,018 A 12/1929 Wermine
(Continued)

FOREIGN PATENT DOCUMENTS

CN 2529429 1/2003
CN 1174814 C 11/2004
(Continued)

OTHER PUBLICATIONS

Notice of Allowance for U.S. Appl. No. 13/801,476 dated Jul. 26, 2016.
(Continued)

*Primary Examiner* — Tuyen Nguyen
(74) *Attorney, Agent, or Firm* — Lorenz & Kopf, LLP

(57) ABSTRACT

Embodiments of an electromagnetic coil assembly are provided, as are methods for the manufacture of an electromagnetic coil assembly. In one embodiment, the method includes joining a first end portion of a braided lead wire to a coiled magnet wire. A dielectric-containing material is applied in a wet-state over the coiled magnet wire and over the first end portion of the braided lead wire. The dielectric-containing material is cured to produce an electrically-insulative body in which the coiled magnet wire and the first end portion of the braided lead wire are at least partially embedded. Prior to application of the dielectric-containing material, the braided lead wire is at least partially impregnated with a masking material deterring wicking of the dielectric-containing material into an intermediate portion of the braided lead wire.

20 Claims, 8 Drawing Sheets

(51) Int. Cl.
*H01F 41/04* (2006.01)
*H01F 5/00* (2006.01)
*H01F 5/06* (2006.01)

(52) U.S. Cl.
CPC ..... *H01F 41/04* (2013.01); *Y10T 29/4902* (2015.01); *Y10T 29/49071* (2015.01); *Y10T 29/49073* (2015.01)

(58) Field of Classification Search
USPC ..... 336/65, 90, 96, 206–208, 192, 107
See application file for complete search history.

(56) References Cited

U.S. PATENT DOCUMENTS 2,262,802 A 11/1941 Hayden
2,787,769 A 4/1957 Hill et al.
2,864,929 A 3/1958 Schwing
2,848,794 A 8/1958 Roth
2,879,361 A 3/1959 Haynman
2,904,619 A 9/1959 Forney, Jr.
2,944,235 A 7/1960 Peters
2,997,647 A 8/1961 Gaugler et al.
3,019,403 A 1/1962 Kamm
3,223,553 A 12/1965 Morey
3,256,417 A 6/1966 Merrett
3,308,411 A 3/1967 Roshala
3,308,414 A 3/1967 Ostrander et al.
3,336,553 A 8/1967 Cripps
3,352,009 A 11/1967 Cohn et al.
3,373,390 A 3/1968 Rechel
3,542,276 A 11/1970 James
3,638,055 A 1/1972 Zimmermann
3,688,397 A 9/1972 Cleaver et al.
3,694,785 A 9/1972 Chass
3,731,368 A 5/1973 Dieteman et al.
3,773,262 A 11/1973 Sparling
3,775,628 A 11/1973 Andersson et al.
3,812,580 A 5/1974 Drugmand
3,862,416 A 1/1975 Phillips et al.
3,881,163 A 4/1975 Lindroth et al.
3,914,859 A 10/1975 Pierson
3,932,928 A 1/1976 King
3,961,151 A 6/1976 Danner
4,056,883 A 11/1977 Danner
4,057,187 A 11/1977 Cranston et al.
4,107,635 A 8/1978 Brundage et al.
4,135,296 A 1/1979 Kami et al.
4,196,510 A 4/1980 Gudmestad et al.
4,228,415 A 10/1980 Schantz
4,258,347 A 3/1981 Konig
4,376,904 A 3/1983 Horrigan
4,429,007 A 1/1984 Bich et al.
4,445,103 A 4/1984 Chass
4,476,192 A 10/1984 Imai et al.
4,524,624 A 6/1985 Di Noia et al.
4,528,086 A 7/1985 Kato et al.
4,554,730 A 11/1985 Westervelt et al.
4,621,251 A 11/1986 Keefe
4,636,763 A 1/1987 Nabstedt et al.
4,641,911 A 2/1987 Pavlak et al.
4,786,760 A 11/1988 Friedhelm
4,866,573 A 9/1989 Bernstein
4,870,308 A 9/1989 Sismour, Jr.
4,950,438 A 8/1990 Nakamura et al.
5,030,877 A 7/1991 Denk
5,091,609 A 2/1992 Sawada et al.
5,105,531 A 4/1992 Sawada et al.
5,122,506 A 6/1992 Wang
5,140,292 A 8/1992 Aronow
5,211,789 A 5/1993 Christian et al.
5,226,220 A 7/1993 Gevas et al.
5,278,496 A 1/1994 Dickmeyer
5,460,503 A 10/1995 Kitajima et al.
5,463,522 A 10/1995 Van Wagener et al.
5,475,203 A 12/1995 McGaffigan
5,493,159 A 2/1996 Norris
5,497,936 A 3/1996 Vojta et al.
5,636,434 A 6/1997 Okey et al.
5,666,099 A 9/1997 Ostrem
5,675,891 A 10/1997 Childs et al.
5,693,208 A 12/1997 Paulet
5,815,091 A 9/1998 Dames et al.
6,009,141 A 12/1999 Hell et al.
6,038,760 A 3/2000 Antoine et al.
6,189,202 B1 2/2001 Masuda et al.
6,261,437 B1 7/2001 Hernnaes et al.
6,304,018 B1 10/2001 Ham
6,368,485 B1 4/2002 Ue et al.
6,668,067 B2 12/2003 Suzuki
6,750,749 B2 6/2004 Horiuchi et al.
6,847,145 B2 1/2005 Van Dine et al.
6,856,065 B2 2/2005 Suzuki
6,909,279 B2 6/2005 Niwa
6,927,666 B2 8/2005 Ahn et al.
6,976,308 B2 12/2005 Jonli
7,096,657 B2 8/2006 Mahoney
7,129,605 B2 10/2006 Zhang et al.
7,147,500 B2 12/2006 Tabata et al.
7,147,929 B2 12/2006 Amagi et al.
7,289,012 B2 10/2007 Tran-Ngoc et al.
7,365,627 B2 4/2008 Yen et al.
7,394,022 B2 7/2008 Gumley
7,459,817 B2 12/2008 VanLuik et al.
7,513,029 B2 4/2009 Ortt et al.
7,572,980 B2 8/2009 Elie et al.
7,588,530 B2 9/2009 Heilman et al.
7,645,522 B2 1/2010 Bischoff et al.
7,705,265 B2 4/2010 Asakura et al.
7,795,538 B2 9/2010 Kaiser et al.
7,893,583 B2 2/2011 Du et al.
7,947,905 B2 5/2011 Pasini
8,058,881 B2 11/2011 Engbring et al.
8,128,441 B2 3/2012 Mukuno
8,205,786 B1 6/2012 Holden
8,253,299 B1 8/2012 Rittenhouse
8,466,767 B2 6/2013 Piascik et al.
8,572,838 B2 11/2013 Piascik et al.
8,581,452 B2 11/2013 Roopnarine
8,754,735 B2 6/2014 Piascik et al.
8,860,541 B2 10/2014 Piascik et al.
2001/0017923 A1 8/2001 Suzuki
2003/0010813 A1 1/2003 Nakaya
2003/0020344 A1 1/2003 Futami et al.
2003/0074884 A1 4/2003 Snow et al.
2004/0010908 A1 1/2004 Kobayashi
2004/0140293 A1 7/2004 Kohama et al.
2004/0158981 A1 8/2004 Antaya et al.
2005/0012423 A1 1/2005 Yasuhara et al.
2005/0127774 A1 6/2005 Sogabe et al.
2005/0225418 A1 10/2005 Tran-Ngoc et al.
2007/0279047 A1 12/2007 Schumacher
2008/0007134 A1 1/2008 Shimura et al.
2009/0121896 A1 5/2009 Mitchell et al.
2009/0134864 A1 5/2009 Hofler
2009/0206974 A1 8/2009 Meinke
2009/0255319 A1 10/2009 Sokol
2009/0273254 A1 11/2009 Heim
2009/0325809 A1 12/2009 Hong et al.
2010/0018768 A1 1/2010 Takahashi et al.
2010/0031497 A1 2/2010 Saka et al.
2010/0176683 A1 7/2010 Waddell et al.
2010/0189884 A1 7/2010 Kaiser et al.
2010/0255282 A1 10/2010 Hong et al.
2011/0054584 A1 3/2011 Alexander et al.
2011/0080062 A1 4/2011 Noh et al.
2011/0192451 A1 8/2011 Sato et al.
2012/0126642 A1 5/2012 Miyamoto et al.
2012/0169174 A1 7/2012 Radov et al.
2012/0175991 A1 7/2012 Tassinario et al.
2013/0082809 A1 4/2013 Holden et al.
2013/0093550 A1 4/2013 Piascik et al.
2013/0285777 A1 10/2013 Piascik et al.
2014/0039258 A1 2/2014 Sekiguchi et al.

(56) References Cited

U.S. PATENT DOCUMENTS

FOREIGN PATENT DOCUMENTS

| | | | |
|---|---|---|---|
| DE | 3830740 | A1 | 3/1990 |
| DE | 102007034322 | A1 | 1/2009 |
| DE | 102010001888 | A1 | 8/2010 |
| EP | 0012422 | A1 | 6/1980 |
| EP | 0886053 | A2 | 12/1998 |
| EP | 2192599 | A1 | 6/2010 |
| FR | 2903246 | A1 | 1/2008 |
| GB | 147786 | | 4/1921 |
| GB | 569196 | | 5/1945 |
| GB | 719126 | A | 11/1954 |
| GB | 1056412 | A | 1/1967 |
| JP | 63209443 | A | 8/1988 |
| JP | 04137516 | A | 5/1992 |
| JP | 2005183554 | A | 7/2005 |
| JP | 2008288512 | A | 11/2008 |
| JP | 2012-105392 | | 5/2012 |

OTHER PUBLICATIONS

USPTO Notice of Allowance for U.S. Appl. No. 14/035,560 dated Sep. 9, 2016.
USPTO Office Action for U.S. Appl. No. 14/741,570 dated Oct. 7, 2016.
USPTO Restriction Requirement for U.S. Appl. No. 13/460,446 dated Jun. 13, 2014.
USPTO Notice of Allowance for U.S. Appl. No. 13/460,446 dated Mar. 4, 2015.
USPTO Office Action, Notification Date Sep. 25, 2014; U.S. Appl. No. 13/460,446.
USPTO Office Action for U.S. Appl. No. 13/038,838, dated Apr. 22, 2013.
USPTO Restriction Requirement for U.S. Appl. No. 14/035,560; Notification date Feb. 2, 2016.
USPTO Final Office Action for U.S. Appl. No. 13/801,476 dated Apr. 15, 2016.
USPTO Office Action for U.S. Appl. No. 14/035,560 dated Jun. 29, 2016.
USPTO Office Action for U.S. Appl. No. 13/801,476; Notification date Nov. 19, 2015.
Brazier, R.F., et al. "Cables for aircraft. Pressure-type connections," Proceedings of the Institution of Electrical Engineers, Jan. 1, 1967, p. 1307, vol. 114, No. 9.
EPO, European Search Report for Application No. 12175199.4, dated Oct. 17, 2012.
Chaklader, et al. "Alumina fibre from aluminium wire, ScienceDirect.com—Composites—Alumina fibre from aluminium wire." Retrieved on Apr. 4, 2012. Retrieved from internet URL<http://www.sciencedirect.com/science/article/pii/0010436181900173.
USPTO Notice of Allowance and Fee(s) Due for U.S. Appl. No. 14/741,570 dated Oct. 24, 2016.
European Search Report for Application No. 12157599.7-1556/2495740 dated Mar. 24, 2017.

ELECTROMAGNETIC COIL ASSEMBLIES HAVING BRAIDED LEAD WIRES AND/OR BRAIDED SLEEVES

CROSS-REFERENCE TO RELATED APPLICATION

This application is a divisional of co-pending U.S. application Ser. No. 13/689,266, filed Nov. 29, 2012.

TECHNICAL FIELD

The present invention relates generally to coiled-wire devices and, more particularly, to electromagnetic coil assemblies including braided lead wires and/or braided electrically-insulative sleeves, as well as to methods for the production of electromagnetic coil assemblies.

BACKGROUND

Sensors (e.g., linear and variable differential transducers), motors, and actuators (e.g., solenoids) commonly include one or more electromagnetic coils formed by wound magnet wire. In certain designs, the electromagnetic coils may be embedded within or encapsulated by a body of dielectric material, such as a potting compound, to provide position holding and electrical insulation between neighboring turns of the coils and thereby improve the overall durability of the coiled-wire device. The opposing ends of the magnet wire may project from the dielectric body to enable electrical connection between the potted electromagnetic coil and an external circuit or power source. In conventional, low temperature applications, the electromagnetic coil is typically embedded within an organic dielectric material, such as a relatively soft rubber or silicone, that has a certain amount of flexibility, elasticity, or compressibility. As a result, a limited amount of movement of the magnet wire at the point at which the wire enters or exits the dielectric body is permitted, which alleviates mechanical stress applied to the magnet wire during assembly and packaging of the coiled-wire device.

While low temperature electromagnetic coils are commonly potted with flexible dielectric materials of the type described above, this is not always the case. Instead, in certain instances, the electromagnetic coil or coils may be embedded within a material or medium that is relatively rigid, such as a hard plastic or certain inorganic materials. As a result, the magnet wire may be effectively fixed or anchored in place at the wire's entry point into or exit point from the dielectric body. Significant mechanical stress concentrations may thus occur at the wire's entry or exit point from the rigid dielectric body as the external portion of the magnet wire is subjected to unavoidable bending, pulling, and twisting forces during the assembly process. The magnet wire may consequently mechanically fatigue and work harden at this interface during assembly and packaging of the coiled-wire device. Work hardening of the magnet wire may result in breakage of the wire during assembly or the creation of a high resistance "hot spot" within the wire accelerating open circuit failure of the coiled-wire device during operation. Such issues are especially problematic when the coiled magnet wire has a relatively fine gauge (e.g., a gauge greater than about 30 American Wire Gauge) and/or is fabricated from a metal prone to work hardening and mechanical fatigue, such as aluminum.

There thus exists an ongoing need to provide embodiments of an electromagnetic coil assembly including a coiled magnet wire, such as a fine gauge aluminum magnet wire, which is at least partly embedded within a body of dielectric material and which is effectively isolated from mechanical stress during manufacture. It would further be desirable, at least in certain embodiments, if such electromagnetic coil assemblies where capable of providing continuous, reliable operation in high temperature applications (e.g., applications characterized by temperatures exceeding 260° C.), such as high temperature avionic applications wherein the electromagnetic coil assembly is integrated into a sensor, motor, actuator, or the like. Finally, it would be desirable to provide embodiments of a method for manufacturing such an electromagnetic coil assembly. Other desirable features and characteristics of the present invention will become apparent from the subsequent Detailed Description and the appended Claims, taken in conjunction with the accompanying Drawings and the foregoing Background.

BRIEF SUMMARY

Embodiments of a method for manufacturing an electromagnetic coil assembly are provided. In one embodiment, the method includes providing a braided lead wire having a first end portion, an intermediate portion, and a second end portion opposite the first end portion. The first end portion of the braided lead wire is joined to a coiled magnet wire. A dielectric-containing material is applied in a wet-state over the coiled magnet wire and over the first end portion of the braided lead wire. The dielectric-containing material is cured to produce an electrically-insulative body in which the coiled magnet wire and the first end portion of the braided lead wire are at least partially embedded. Prior to application of the dielectric-containing material, the braided lead wire is at least partially impregnated with a masking material deterring wicking of the dielectric-containing material into the intermediate portion of the braided lead wire.

Embodiments of an electromagnetic coil assembly are further provided. In one embodiment, the electromagnetic coil assembly includes a body of dielectric material, a coiled magnet wire at least partially embedded in the body of dielectric material, and a braided lead wire. The braided lead wire includes an end portion and an intermediate portion. The end portion of the braided lead wire extends into the body of dielectric material and is joined to the coiled magnet wire. The intermediate portion of the braided lead wire is external to the body of dielectric material and is substantially devoid of the dielectric material. At least a portion of the end portion of the braided lead wire is infiltrated by the dielectric material.

BRIEF DESCRIPTION OF THE DRAWINGS

At least one example of the present invention will hereinafter be described in conjunction with the following figures, wherein like numerals denote like elements, and.

DETAILED DESCRIPTION

Figure 1:
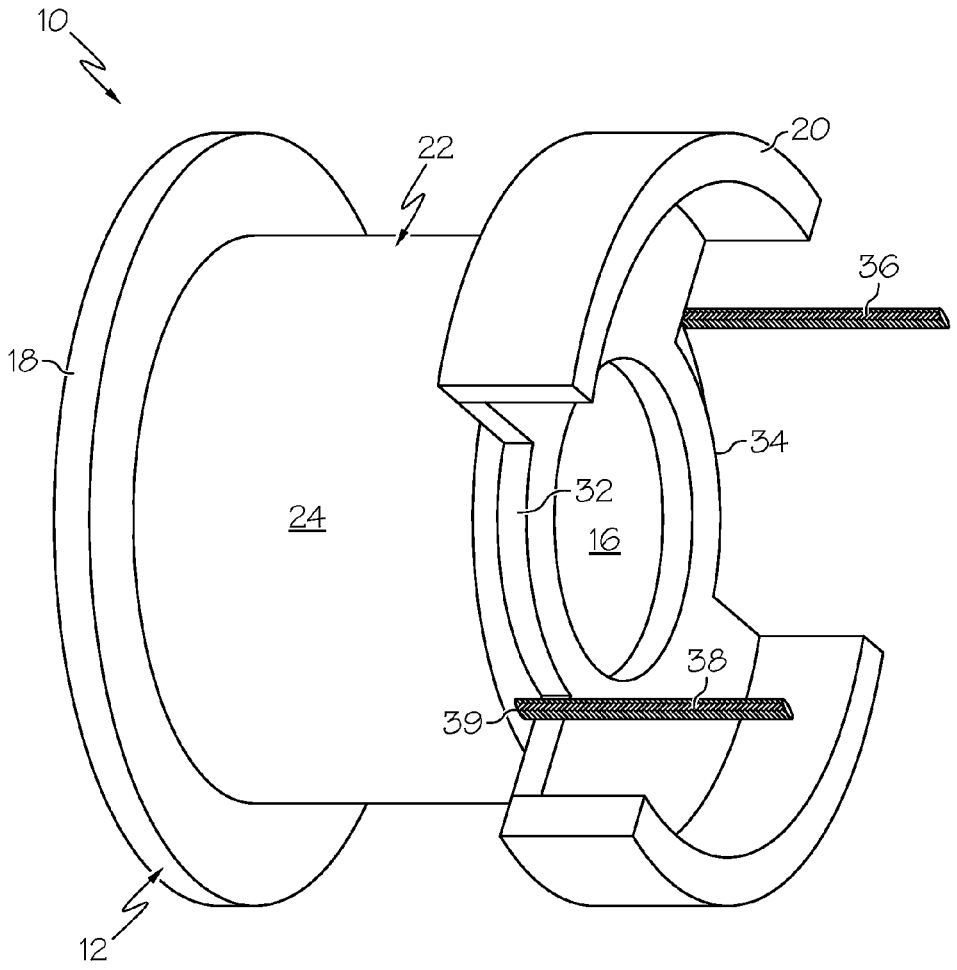
FIGS. 1 and 2 are isometric and cross-sectional views, respectively, of an electromagnetic coil assembly including a plurality of braided lead wires (partially shown) illustrated in accordance with an exemplary embodiment of the present invention.

The following Detailed Description is merely exemplary in nature and is not intended to limit the invention or the application and uses of the invention. Furthermore, there is no intention to be bound by any theory presented in the preceding Background or the following Detailed Description. As appearing herein, the term "aluminum" encompasses materials consisting essentially of pure aluminum, as well as aluminum-based alloys containing aluminum as a primary constituent in addition to any number of secondary metallic or non-metallic constituents. This terminology also applies to other metals named herein; e.g., the term "nickel" encompasses pure and near pure nickel, as well as nickel-based alloys containing nickel as a primary constituent.

Embodiments of the electromagnetic coil assemblies described herein employ braided lead wires, which terminate within the dielectric body and provide a convenient means of electrical connection to the coiled magnet wire or wires embedded therein. In such embodiments, each braided lead wire may assume the form of a plurality of interwoven filaments or single-strand conductors, which are interwoven into an elongated ribbon, tube, or the like having an extremely high flexibility and mechanical strength. As a result, and in contrast to fine gauge single strand magnet wires, the braided lead wires are able to withstand significant and repeated mechanical stress without experiencing mechanical fatigue and work hardening. Furthermore, as each braided lead wire is comprised of numerous interwoven filaments, the braided lead wires provide added redundancy in the electrical connection to the potted coil or coils thereby improving the overall durability and reliability of the electromagnetic coil assembly. Additional description of electromagnetic coil assemblies employing braided lead wires is further provided in co-pending U.S. application Ser. No. 13/276,064, entitled "ELECTROMAGNETIC COIL ASSEMBLIES HAVING BRAIDED LEAD WIRES AND METHODS FOR THE MANUFACTURE THEREOF," and filed Oct. 18, 2011, which bears a common assignee with the Instant Application and which is hereby incorporated by reference. In further embodiments, the electromagnetic coil assemblies described herein include braided electrically-insulative sleeves, such as woven fiberglass tubes or sheathes, which are disposed around the lead wires and extend into the potted dielectric body to provide electrical insulation between the braided lead wires and the coiled magnet wire and any other neighboring electrically-conductive components that may be included in the coil assembly, such as an external housing or case. In these latter embodiments, the lead wires extending into the dielectric body to the coiled magnet wire are preferably braided, but may also be non-braided conductors, such as a unitary wire having a gauge coarser than that of the wound magnet wire (e.g., a gauge less than 30 AWG). Thus, in such embodiments, the electromagnetic coil assembly can include one or more electrically-insulative sleeves that are impregnated with masking material during manufacture and that are positioned over one or more solid or non-woven lead wires, which are not impregnated with masking material during manufacture.

During fabrication of the electromagnetic coil assemblies, a dielectric-containing material is applied in a wet or flowable state over a coiled magnet wire as, for example, a slurry or paste. The dielectric-containing material is then cured to produce a rigid or solid-state electrically-insulative body in which the coiled magnet wire is at least partially embedded or encased. Lead wires extending into the electrically-insulative body are joined to opposing end portions of the coiled magnet wire to enable electrical connection thereto from a point external to the potted coil. During manufacture, the lead wires are contacted by the dielectric-containing material as it is applied in a wet-state over the coiled magnet wire. In embodiments wherein at least one of the lead wires is a braided or woven multi-strand conductor, capillary action may cause the undesired migration or wicking of the wet-state, dielectric-containing material into the body of the braided lead wires. When the dielectric-containing material hardens during the curing process, the portion or portions of the braided lead wires infiltrated by the dielectric-containing material also harden destroying the pliability or flexibility of the infiltrated portions of the braided lead wires. Hardening or embrittlement of the portions of the braided lead wires projecting from the dielectric body can create a sheer point location near the wire's entry point into/exit point from the dielectric body thereby increasing the likelihood of breakage during manufacture. Embrittlement of the external portions of the braided lead wires thus renders packaging, handling, and processing of the electromagnetic coil assembly overly difficult, can limit product yield, and can increase latent failures. Similar issues are also encountered when the electromagnetic coil assembly includes one or more braided electrically-insulative sleeves, in addition to or in lieu of one or more braided lead wires, which are likewise contacted by the dielectric-containing material when applied in a wet-state over the coiled magnet wire during fabrication of the electromagnetic coil assembly.

In accordance with embodiments of the present invention, the following describes methods of manufacturing an electromagnetic coil assembly wherein the flexibility or pliability of at least one braided lead wire and/or braided electrically-insulative sleeve is preserved or maintained through the wet-state application and curing of a dielectric-containing material applied over one or more coiled magnet wires included in the coil assembly. In embodiments wherein the electromagnetic coil assembly includes at least one braided lead wire, selected portions of the braided lead wire may be impregnated with a masking material to prevent wicking or undesired migration of the dielectric-containing material into the body of the lead wire external to the electrically-insulative body produced pursuant to curing. Also, by leaving the terminal end segments of the braided lead wires extending into electrically-insulative body and allowing the inflow of the dielectric-containing material into the penetrating segments of the lead wires, the lead wires' penetrating end segments are effectively anchored in place, which further strengths the wire-to-lead joints buried within the electrically-insulative body and which further shields the wire-to-lead joints from externally applied stressors. Conversely, the terminal end portions of the lead wires extending into the electrically-insulative body may intentionally be left unmasked to allow infiltration of the dielectric-containing material so as to prevent or at least reduce the creation of voids within the electrically-insulative body, which can otherwise reduce vibration and shock resistance. The opposing terminal end portions of the lead wires may likewise be left unmasked to facilitate joinder to electrically-conductive interconnect members, such as the metal pins or wires of a feedthrough device, as described more fully below. Similarly, in instances wherein the electromagnetic coil assembly includes at least one electrically-insulative braided sleeve or sheath in addition to, or in lieu of, at least one braided lead wire, selected portions of the braided sheath may be impregnated with a masking material to prevent or deter the undesired wicking of the dielectric-containing material into the body of the sleeve to preserve the flexibility thereof during the manufacturing process.

Figure 2:
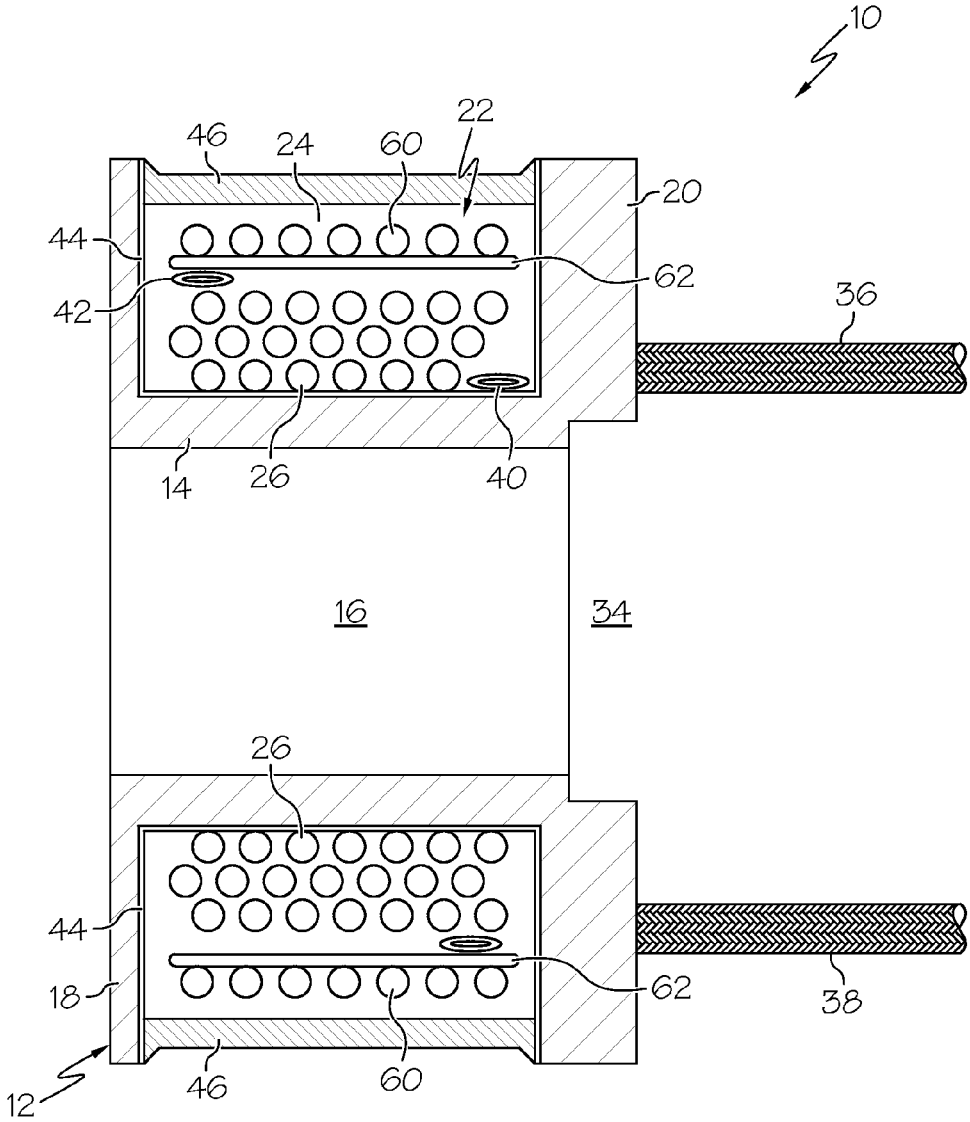

FIGS. 1 and 2 are isometric and cross-sectional views, respectively, of an electromagnetic coil assembly 10 illustrated in accordance with an exemplary embodiment of the present invention. Electromagnetic coil assembly 10 includes a support structure around which at least one magnet wire is wound to produce one or more electromagnetic coils. In the illustrated example, the support structure assumes the form of a hollow spool or bobbin 12 having an elongated tubular body 14 (identified in FIG. 2), a central channel 16 extending through tubular body 14, and first and second flanges 18 and 20 extending radially from opposing ends of body 14. As shown most clearly in FIG. 2, a magnet wire 26 is wound around tubular body 14 to form a multi-layer, multi-turn electromagnetic coil, which is at least partially embedded within, encrusted by, or encapsulated by a body of dielectric material 24 (referred to herein as "electrically-insulative body 24"). In addition to providing electrical insulation between neighboring turns of coiled magnet wire 26 through the operative temperature range of the electromagnetic coil assembly 10, electrically-insulative body 24 also serves as a bonding agent providing mechanical isolation and position holding of coiled magnet wire 26 and the lead wire portions extending into electrically-insulative body 24 (described below). By immobilizing the embedded coil (or coils) and the embedded lead wire portions, electrically-insulative body 24 prevents wire chaffing and abrasion when electromagnetic coil assembly is utilized within a high vibratory environment. Collectively, coiled magnet wire 26 and electrically-insulative body 24 form a potted electromagnetic coil 22. While shown as including a single electromagnetic coil in FIGS. 1 and 2, it will be appreciated that embodiments of electromagnetic coil assembly 10 can include two or more coils positioned in various different spatial arrangements.

In embodiments wherein electromagnetic coil assembly 10 is incorporated into a sensor, such as an LVDT, bobbin 12 is preferably fabricated from a non-ferromagnetic material, such as aluminum, a non-ferromagnetic 300 series stainless steel, or a ceramic. However, in embodiments wherein assembly 10 is incorporated into a solenoid, a motor, or the like, either a ferromagnetic or non-ferromagnetic material may be utilized. Furthermore, in embodiments wherein bobbin 12 is fabricated from an electrically-conductive material, an insulative coating or shell 44 (shown in FIG. 2) may be formed over the outer surface of bobbin 12. For example, in embodiments wherein bobbin 12 is fabricated from a stainless steel, bobbin 12 may be coated with an outer dielectric material utilizing, for example, a brushing, dipping, drawing, or spraying process; e.g., a glass may be brushed onto bobbin 12 as a paste or paint, dried, and then fired to form an electrically-insulative coating over selected areas of bobbin 12. As a second example, in embodiments wherein electromagnetic coil assembly 10 is disposed within an airtight or at least a liquid-tight package, such as a hermetic canister of the type described below in conjunction with FIGS. 6 and 7, an electrically-insulative inorganic cement of the type described below may be applied over the outer surfaces of bobbin 12 and cured to produce the electrically-insulative coating providing a breakdown voltage standoff between bobbin 12 and coiled magnet wire 26. As a further possibility, in embodiments wherein bobbin 12 is fabricated from aluminum, bobbin 12 may be anodized to form an insulative alumina shell over the bobbin's outer surface. In still further embodiments, bobbin 12 can be wrapped with a ceramic- or fiberglass-containing tape. In such cases, the tape may also contain organic materials, such as organic adhesives, which are burned away or otherwise decomposed during the below-described curing process.

Coiled magnet wire 26 may be formed from a magnet wire having a relatively fine gauge; e.g., by way of non-limiting example, a gauge of about 30 to about 38 AWG, inclusive. However, embodiments of the present invention are also advantageously utilized when the coiled magnet wire is of a larger wire gauge (e.g., about 20 to 28 AWG) and could chip or otherwise damage the surrounding dielectric material during manipulation if allowed to pass from the interior to the exterior of electrically-insulative body 24. Thus, in preferred embodiments, the gauge of coiled magnet wire 26 may range from about 20 to about 38 AWG. Coiled magnet wire 26 may be fabricated from any suitable metal or metals including, but not limited to, copper, aluminum, nickel, and silver. Coiled magnet wire 26 may or may not be plated. When electromagnetic coil assembly 10 is designed for usage within a high temperature environment, coiled magnet wire 26 is preferably fabricated from aluminum, silver, nickel, or clad-copper (e.g., nickel-clad copper). Advantageously, both aluminum and silver wire provide excellent conductivity enabling the dimensions and overall weight of assembly 10 to be reduced, which is especially desirable in the context of avionic applications. Relative to silver wire, aluminum wire is less costly and can be anodized to provide additional electrical insulation between neighboring turns of coiled magnet wire 26 and bobbin 12 and thereby reduce the likelihood of shorting and breakdown voltage during operation of assembly 10. By comparison, silver wire is more costly than aluminum wire, but is also more conductive, has a higher mechanical strength, has increased temperature capabilities, and is less prone to work hardening. The foregoing notwithstanding, coiled magnet wire 26 is preferably fabricated from aluminum wire and, more preferably, from anodized aluminum wire.

In low temperature applications, electrically-insulative body 24 may be formed from an organic material, such as a hard plastic. In high temperature applications, however, electrically-insulative body 24 is formed from one or more inorganic materials and may be substantially devoid of organic matter; that is, body 24 may contain less than 1% organic constituents, as measured by weight. In such cases, electrically-insulative body 24 is preferably formed from a ceramic medium or material; i.e., an inorganic and non-metallic material, whether crystalline or amorphous. Furthermore, in embodiments wherein coiled magnet wire 26 is produced utilizing anodized aluminum wire, electrically-insulative body 24 is preferably formed from a material having a coefficient of thermal expansion ("CTE") approaching that of aluminum (approximately 23 parts per million per degree Celsius), but preferably not exceeding the CTE of aluminum, to minimize the mechanical stress applied to the anodized aluminum wire during thermal cycling. Thus, in embodiments wherein coiled magnet wire 26 is produced from anodized aluminum wire, electrically-insulative body 24 is preferably formed to have a CTE exceeding approximately 10 parts per million per degree Celsius ("ppm per ° C.") and, more preferably, a CTE between approximately 16 and approximately 23 ppm per ° C. Suitable materials include inorganic cements and certain low melt glasses (i.e., glasses or glass mixtures having a melting point less than the melting point of anodized aluminum wire), such as leaded borosilicate glasses. As a still more specific example, electrically-insulative body 24 may be produced from a water-activated, silicate-based cement, such as the sealing cement bearing Product No. 33S and commercially available from the SAUEREISEN® Cements Company, Inc., headquartered in Pittsburgh, Pa. Additional description of materials and methods useful in the formation of electrically-insulative body 24 is provided in co-pending U.S. application Ser. No. 13/038,838, entitled "HIGH TEMPERATURE ELECTROMAGNETIC COIL ASSEMBLIES AND METHODS FOR THE PRODUCTION THEREOF," and filed Mar. 2, 2011, which bears a common assignee with the Instant Application and which is hereby incorporated by reference.

Electrically-insulative body 24 may be produced utilizing a process wherein a selected dielectric-containing material is applied in a wet or flowable state over the coiled magnet wire (e.g., as a paste, slurry, paint, etc.) and then subjected to a high temperature curing process. As appearing herein, the phrase "wet-state application," the term "wet-state," and similar terms and phrases are utilized to indicate that the dielectric-containing material is mixed, dissolved, or otherwise combined with sufficient liquid to enable application of the dielectric-containing material by painting, dipping, brushing, spraying, wet winding, or similar application technique. In a preferred, albeit non-limiting embodiment, the dielectric-containing material is applied over the coiled magnet wire and the adjoining end segments of the lead wires and/or braided sleeves utilizing a wet winding process of the type described below. The term "wet-state application" also encompasses the application of organic dielectric materials, such as plastics, under temperature and/or pressures wherein the organic dielectric materials are melted, liquefied, or softened and can be dispensed, injected, or otherwise flowed over the coiled magnet wire.

As noted above, the dielectric-containing material from which electrically-insulative body 24 is formed is preferably applied over coiled magnet wire 26 utilizing a wet winding process. During wet winding, the magnet wire is wound around bobbin 12 while a dielectric-containing material is applied over the wire's outer surface in a wet or flowable state to form a viscous coating thereon. In an embodiment, the dielectric-containing material contains a ceramic or other inorganic material that is mixed with, dissolved within, or otherwise combined with a sufficient quantity of liquid to be applied over the magnet wire in real-time during the wet winding process by brushing, spraying, or a similar application technique. In the wet-state, the dielectric-containing material may assume the form of a pre-cure (e.g., water-activated) cement or a plurality of ceramic (e.g., low melt glass) particles dissolved in a solvent, such as a high molecular weight alcohol, to form a slurry or paste. The selected dielectric-containing material may be continually applied in a wet-state over the full width of the magnet wire to the entry point of the coil such that the puddle of liquid is formed through which the existing wire coils continually pass. The magnet wire may be slowly turned during application of the dielectric material by, for example, a rotating apparatus or wire winding machine, and a relatively thick layer of the dielectric-containing material may be continually brushed onto the wire's surface to ensure that a sufficient quantity of the material is present to fill the space between neighboring turns and multiple layers of coiled magnet wire 26. In large scale production, application of the selected dielectric-containing material to the magnet wire may be performed utilizing a pad, brush, or automated dispenser, which dispenses a controlled amount of the dielectric material over the wire during winding.

As noted above, electrically-insulative body 24 can be fabricated from dielectric-containing material comprising a mixture of at least a low melt glass and a particulate filler material. Low melt glasses having coefficients of thermal expansion exceeding approximately 10 ppm per ° C. include, but are not limited to, leaded borosilicates glasses. Commercially available leaded borosilicate glasses include 5635, 5642, and 5650 series glasses having processing temperatures ranging from approximately 350° C. to approximately 550° C. and available from KOARTAN™ Microelectronic Interconnect Materials, Inc., headquartered in Randolph, N.J. The material containing the low melt glass is conveniently applied as a paste or slurry, which may be formulated from ground particles of the low melt glass, the particulate filler material, a solvent, and a binder. In a preferred embodiment, the solvent is a high molecular weight alcohol resistant to evaporation at room temperature, such as alpha-terpineol or TEXINOL®; and the binder is ethyl cellulose, an acrylic, or similar material.

It is desirable to include a particulate filler material in the embodiments wherein the electrically-insulative, inorganic material comprises a low melt glass to prevent relevant movement and physical contact between neighboring coils of the anodized aluminum wire during coiling and firing processes. Although the filler material may comprise any particulate material suitable for this purpose (e.g., zirconium or aluminum powder), binder materials having particles generally characterized by thin, sheet-like shapes (commonly referred to as "platelets" or "laminae") have been found to better maintain relative positioning between neighboring coils as such particles are less likely to dislodge from between two adjacent turns or layers of the wire's cured outer surface than are spherical particles. Examples of suitable binder materials having thin, sheet-like particles include mica and vermiculite. The dielectric-containing material, and thus the low melt glass, is conveniently applied to the magnet wire in a wet state by brushing immediately prior to the location at which the wire is coiled around the support structure utilizing a wet winding process of the type described above.

After application of the dielectric-containing material over the coiled magnet wire, whether by the above-described wet winding process or another wet-state application process, the green state dielectric-containing material is cured to produce electrically-insulative body 24. As appearing herein, the term "curing" denotes exposing the wet-state, dielectric-containing material to process conditions (e.g., temperatures) sufficient to transform the material into a solid dielectric medium or body, whether by chemical reaction, by melting of particles, or otherwise. The term "curing" is thus defined to include firing of, for example, low melt glasses. In many cases, curing of the chosen dielectric-containing material will involve thermal cycling over a relatively wide temperature range, which will typically entail exposure to elevated temperatures well exceeding room temperatures (e.g., about 20-25° C.), but less than the melting point of the magnet wire (e.g., in the case of anodized aluminum wire, approximately 660° C.). However, in embodiments wherein the chosen dielectric-containing material is an inorganic cement curable at or near room temperature, curing may be performed, at least in part, at correspondingly low temperatures. For example, if the chosen dielectric-containing material is an inorganic cement, partial curing may be performed at a first temperature slightly above room temperature (e.g., at approximately 82° C.) to drive out excess moisture before further curing is performed at higher temperatures exceeding the boiling point of water. In preferred embodiments, curing is performed at temperatures up to the expected operating temperatures of electromagnetic coil assembly 10, which may approach or exceed approximately 315° C. In embodiments wherein coiled magnet wire 26 is produced utilizing anodized aluminum wire, it is also preferred that the curing temperature exceeds the annealing temperature of aluminum (e.g., approximately 340° C. to 415° C., depending upon wire composition) to relieve any mechanical stress within the aluminum wire created during the coiling and crimping process described below. High temperature curing may also form aluminum oxide over any exposed areas of the anodized aluminum wire created by abrasion during winding to further reduces the likelihood of shorting.

In embodiments wherein electrically-insulative body 24 is composed of a material susceptible to water intake, such as a porous inorganic cement, it is desirable to prevent the ingress of water into body 24. As will be described more fully below, electromagnetic coil assembly 10 may further include a housing or container, such as a generally cylindrical canister, in which bobbin 12, electrically-insulative body 24, and coiled magnet wire 26 are hermetically sealed. In such cases, the ingress of moisture into the hermetically-sealed container and the subsequent wicking of moisture into electrically-insulative body 24 is unlikely. However, if additional moisture protection is desired, a liquid sealant may be applied over an outer surface of electrically-insulative body 24 to encapsulate body 24, as indicated in FIG. 1 at 46. Sealants suitable for this purpose include, but are limited to, waterglass, silicone-based sealants (e.g., ceramic silicone), and low melt (e.g., lead borosilicate) glass materials of the type described above. A sol-gel process can be utilized to deposit ceramic materials in particulate form over the outer surface of electrically-insulative body 24, which may be subsequently heated, allowed to cool, and solidify to form a dense water-impenetrable coating over electrically-insulative body 24.

To provide electrical connection to the electromagnetic coil embedded within dielectric inorganic body 24, lead wires are joined to opposing ends of coiled magnet wire 26. In certain embodiments, one or both of the lead wires joined to coiled magnet wire 26 may not be braided. It is generally preferred, however, that both lead wires joined to coiled magnet wire 26 have a braided or woven structure for the reasons explained above; e.g., increased flexibility, resistance to fatigue and work hardening, and added redundancy. For this reason, and by way of non-limiting example only, electromagnetic coil assembly 10 is shown in FIGS. 1 and 2 as including first and second braided lead wires 36 and 38, which are joined to opposing end portions of coiled magnet wire 26. Braided lead wires 36 and 38 extend into or emerge from electrically-insulative body 24 at side entry/exit points 39 (one of which is labeled in FIG. 1). Braided lead wires 36 and 38 thus each include a terminal end portion or segment, which extends into and is contained within electrically-insulative body 24 and which is joined to an opposing end portion of coiled magnet wire 26. If desired, electrically-insulative braided or woven sleeves may be positioned over the terminal end portions of braided lead wires 36 and 38 and may likewise extend from electrically-insulative body 24, as described more fully below in conjunction with FIG. 4.

In the illustrated example shown in FIGS. 1 and 2, braided lead wires 36 and 38 each assume the form of a plurality of filaments (e.g., 24 fine gauge filaments) interwoven into a flat ribbon, an elongated tube (shown in FIGS. 1 and 2), or a similar woven structure. Braided lead wires 36 and 38 can be fabricated from a wide variety of metals and alloys, including copper, aluminum, nickel, stainless steel, and silver. Depending upon the particular metal or alloy from which braided lead wires 36 and 38 are formed, the lead wires may also be plated or clad with various metals or alloys to increase electrical conductivity, to enhance crimping properties, to improve oxidation resistance, and/or to facilitate soldering or brazing. Suitable plating materials include, but are not limited to, nickel, aluminum, gold, palladium, platinum, and silver. As shown most clearly in FIG. 1, first and second axial slots 32 and 34 may be formed through radial flange 20 of bobbin 12 to provide a convenient path for routing braided lead wires 36 and 38 to the exterior of potted electromagnetic coil 22.

Braided lead wire 36 is mechanically and electrically joined to a first end portion of coiled magnet wire 26 by way of a first joint 40 (FIG. 2). Similarly, a second braided lead wire 38 is mechanically and electrically joined to an opposing end portion of coiled magnet wire 26 by way of a second joint 42 (FIG. 2). As will be described more fully below, joints 40 and 42 may be formed by any suitable combination of soldering, crimping, twisting, or the like. In preferred embodiments, joints 40 and 42 are embedded or buried within electrically-insulative body 24. Joints 40 and 42, and therefore the opposing end portions of coiled magnet wire 26, are thus mechanically isolated from bending and pulling forces exerted on the external portions of braided lead wires 36 and 38. Consequently, in embodiments wherein coiled magnet wire 26 is produced utilizing a fine gauge wire and/or a metal (e.g., anodized aluminum) prone to mechanical fatigue and work hardening, the application of strain and stress to coiled magnet wire 26 is consequently minimized and the development of high resistance hot spots within wire 26 is avoided. By comparison, due to their interwoven structure, braided lead wires 36 and 38 are highly flexible and can be repeatedly subjected to significant bending, pulling, twisting, and other manipulation forces without appreciable mechanical fatigue or work hardening. Additionally, as braided lead wires 36 and 38 each contain a plurality of filaments, lead wires 36 and 38 provide redundancy and thus improve the overall reliability of electromagnetic coil assembly 10. If desired, an electrically-insulative (e.g., fiberglass or ceramic) cloth 62 can be wrapped around the outer circumference of coiled magnet wire 26 to further electrically insulate the electromagnetic coil and/to mechanically reinforce joints 40 and 42. Depending upon coil assembly design and purpose, and as generically represented in FIG. 2 by a single layer of wound wire 60, one or more additional coils may further be wound around the central coil utilizing similar fabrication processes.

Figure 3:
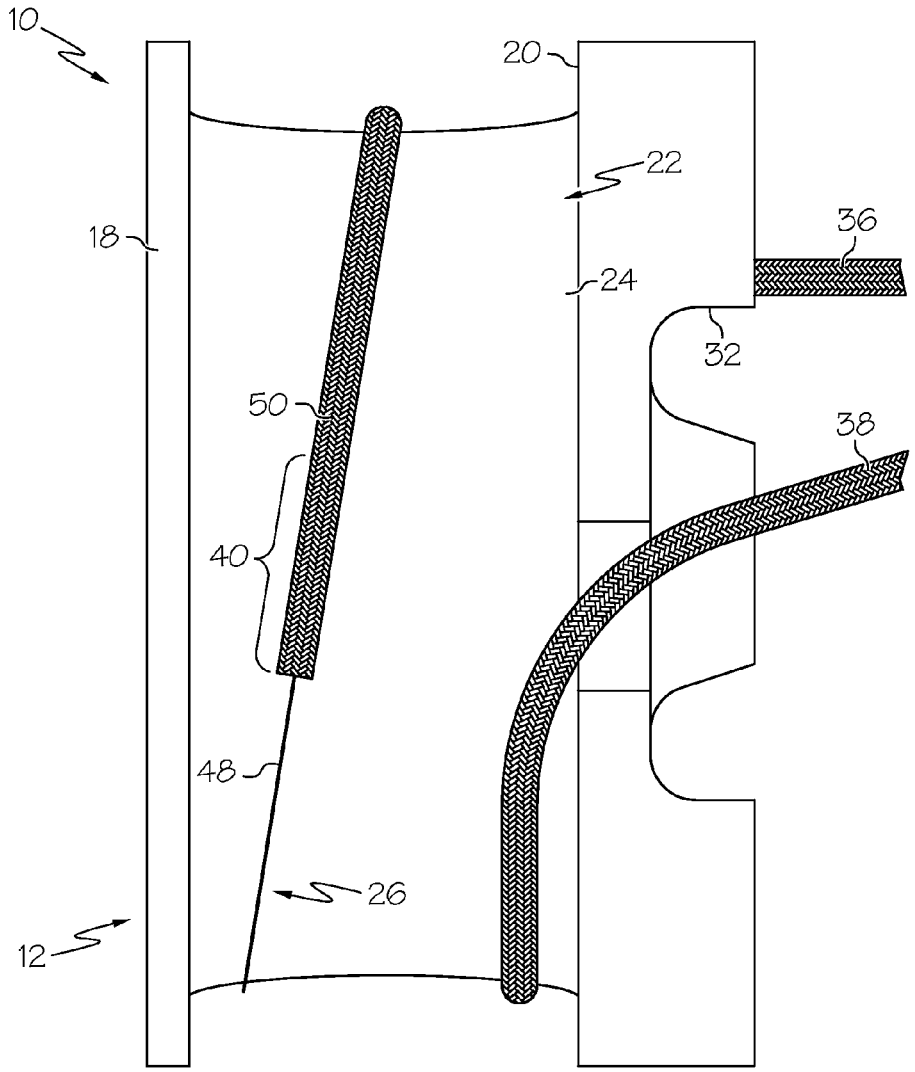
FIG. 3 is a side view of electromagnetic coil assembly shown in FIGS. 1 and 2 during an intermediate stage of manufacture and illustrating one manner in which a braided lead wire can be joined to an end portion of the coiled magnet wire.

To facilitate connection to a given braided lead wire, the coiled magnet wire is preferably inserted or threaded into the braided lead wire prior to formation of the wire-to-lead joint. In embodiments wherein the braided lead wire is a flat woven ribbon (commonly referred to as a "flat braid"), the fine gauge magnet wire may be inserted through the sidewall of the interwoven filaments and, perhaps, woven into the braided lead wire by repeatedly threading the magnet wire through the lead wire's filaments in an undulating pattern. Alternatively, in embodiments wherein the braided lead is an interwoven tube (commonly referred to as a "hollow braid"), an end portion of the coiled magnet wire may be inserted into the central opening of the tube or woven into the braided lead wire in the previously-described manner. For example, as shown in FIG. 3, which is a side view of electromagnetic coil assembly 10 in a partially-fabricated state, an end portion 48 of coiled magnet wire 26 may be inserted into an end portion 50 of braided lead wire 36 forming joint 40. End portion 50 of braided lead wire 38 is preferably wrapped around the circumference of the electromagnetic coil and ultimately exits the assembly through slot 32 to provide a gradual transition minimizing the application of mechanical stress to end portion 48 of coiled magnet wire 26. If desired, the portion 50 of braided lead wire 38 wrapped around the circumference of the electromagnetic coil assembly may be flattened to reduce the formation of any bulges within the finished electromagnetic coil.

As noted above, and referring to FIG. 4, a flexible, electrically-insulative braided sleeve 56 (e.g., a woven fiberglass tube) may be inserted over terminal end portion 50 of braided lead wire 38 wrapped around the circumference of electromagnetic coil assembly 10 to provide additional electrical insulation. It should be noted that, in FIG. 4, electromagnetic coil assembly 10 is shown in a partially-fabricated state wherein electrically-insulative body 24 is only partially formed and shown in a pre-cure or green state. After formation of joint 40 (FIG. 3) and positioning of sleeve 56 (FIG. 4), additional dielectric-containing material may be applied over joint 40 and the portion of sleeve 56 wrapping around the portion of green body 24 previous deposited. As a result, joint 40 and a portion of sleeve 56 will be buried or embedded within the outer regions of electrically-insulative body 24, when completed and transformed into a hardened or solid state pursuant to curing. Similarly, an electrically-insulative braided sleeve 57 (partially hidden from view in FIG. 4) can be positioned over the terminal end portion of braided lead wire 36 joined to the opposing end of magnet wire 26 (FIG. 2). In one implementation, electrically-insulative braided sleeve 57 is positioned over the terminal end portion of braided lead wire 36 after joining to magnet wire 26 (FIG. 2) and prior to the wet-state application of the dielectric-containing material utilized to produce electrically-insulative body 24.

Joints 40 and 42 may be formed by any suitable combination of soldering (e.g., brazing), crimping, twisting, or the like. In preferred embodiments, joints 40 and 42 are formed by soldering and/or crimping. For example, and as indicated in FIG. 5 by arrows 52, end portion 50 of hollow braided lead wire 36 may be crimped over end portion 48 of coiled magnet wire 26. In forming crimp joint 40, a deforming force is applied to opposing sides of end portion 50 of braided lead wire 38 into which end portion 48 of coiled magnet wire 26 has previously been inserted. In this manner, end portion 50 of braided hollow lead wire 38 serves as a crimp barrel, which is deformed over and around end portion 48 of coiled magnet wire 26. The crimping process is controlled to induce sufficient deformation through crimp joint 42 to ensure the creation of a metallurgical bond or cold weld between coiled magnet wire 26 and braided lead wire 38 forming a mechanical and electrical joint. Crimping can be performed with a hydraulic press, pneumatic crimpers, or certain hand tools (e.g., hand crimpers and/or a hammer). In embodiments wherein braided lead wires are crimped to opposing ends of the magnet wire, it is preferred that the braided lead wires and the coiled magnet wire are fabricated from materials having similar or identical hardnesses to ensure that the deformation induced by crimping is not overly concentrated in a particular, softer wire; e.g., in preferred embodiments wherein joints 40 and 42 are formed by crimping, coiled magnet wire 26, braided lead wire 36, and braided lead wire 38 may each be fabricated from aluminum. Although not shown in FIGS. 3-5 for clarity, braided lead wire 36 may be joined to the opposing end of coiled magnet wire 26 utilizing a similar crimping process. While only a single crimp joint is shown in FIG. 5 for simplicity, it will be appreciated that multiple crimps can be utilized to provide redundancy and ensure optimal mechanical and/or electrical bonding of the braided lead wires and the coiled magnet wire. It may be desirable to impart one or more of the crimp joints included within electromagnetic coil assembly 10 with a tapered geometry to ensure the simultaneous formation of optimal metallurgical and electrical bonds, as described more fully in co-pending U.S. application Ser. No. 13/187,359, entitled "ELECTROMAGNETIC COIL ASSEMBLIES HAVING TAPERED CRIMP JOINTS AND METHODS FOR THE FABRICATION THEREOF," and filed Jul. 20, 2011, which bears a common assignee with the Instant Application and which is hereby incorporated by reference.

In addition to or in lieu of crimping, end portion 50 of braided lead wire 38 may be joined to end portion 48 of coiled magnet wire 26 by soldering. In this case, solder material, preferably along with flux, may be applied to joint 40 and heated to cause the solder material to flow into solder joint 40 to mechanically and electrically join magnet wire 26 and lead wire 38. A braze stop-off material is advantageously impregnated into or otherwise applied to braided lead wire 38 adjacent the location at which braided lead wire 38 is soldered to coiled magnet wire 26 (represented in FIG. 4 by dashed circle 54) to prevent excessive wicking of the solder material away from joint 40. Soldering may be performed by exposing the solder materials to an open flame utilizing, for example, a microtorch. Alternatively, soldering or brazing may be performed in a controlled atmosphere oven. The oven is preferably purged with an inert gas, such as argon, to reduce the formation of oxides on the wire surfaces during heating, which could otherwise degrade the electrical bond formed between coiled magnet wire 26 and braided lead wires 36 and 38. If containing potentially-corrosive constituents, such as fluorines or chlorides, the flux may be chemically removed after soldering utilizing a suitable solvent.

In certain embodiments, such as when the coiled magnet wire 26 is fabricated from an oxidized aluminum wire, it may be desirable to remove oxides from the outer surface of magnet wire 26 and/or from the outer surface of braided lead wire 38 prior to crimping and/or brazing/soldering. This can be accomplished by polishing the wire or wires utilizing, for example, an abrasive paper or a commercially-available tapered cone abrasive dielectric stripper typically used for fine gauge wire preparation. Alternatively, in the case of oxidized aluminum wire, the wire may be treated with a suitable etchant, such as sodium hydroxide (NaOH) or other caustic chemical, to remove the wire's outer alumina shell at the location of crimping and/or soldering. Advantageously, such a liquid etchant can be easily applied to localized areas of the magnet wire and/or braided lead wire utilizing a cotton swab, a cloth, or the like. When applied to the wire's outer surface, the liquid etchant penetrates the relatively porous oxide shell and etches away the outer annular surface of the underlying aluminum core thereby undercutting the outer alumina shell, which then flakes or falls away to expose the underlying core.

Figure 4:
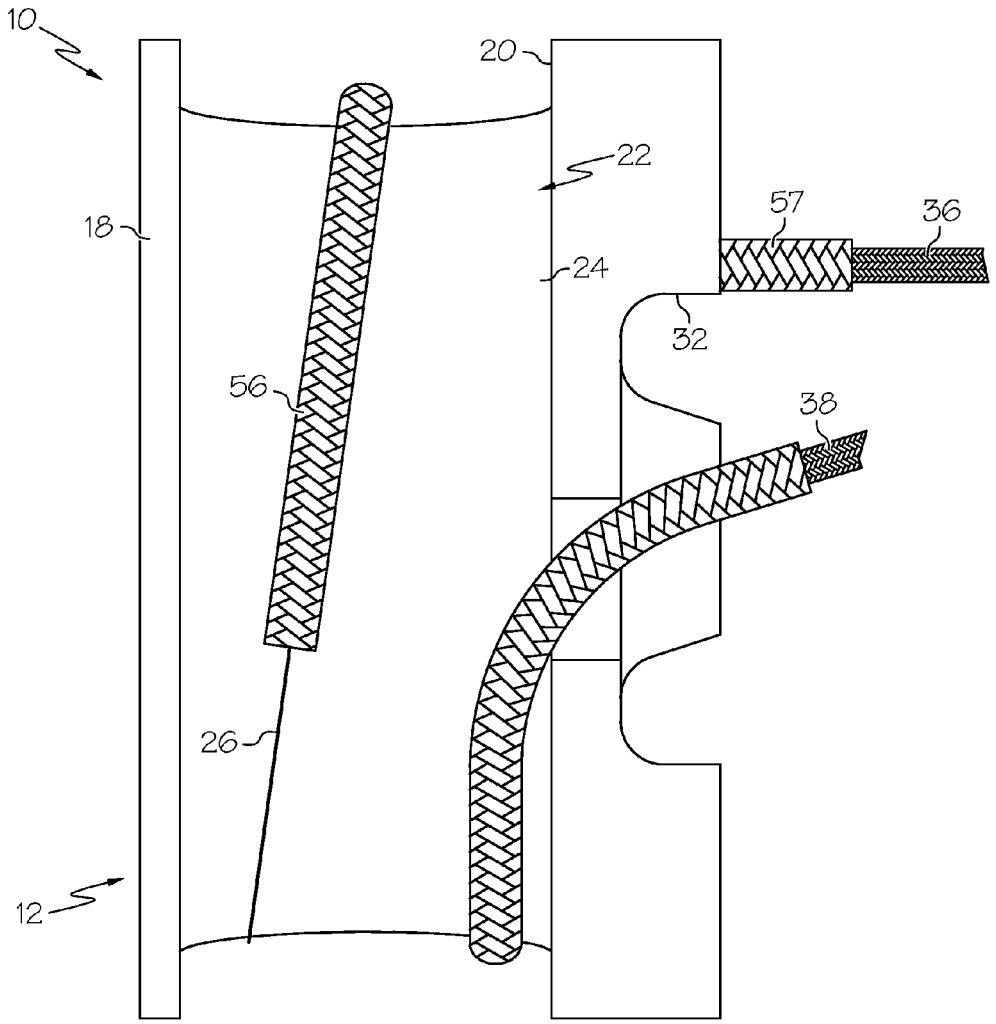
FIG. 4 is a side view of the partially-fabricated electromagnetic coil assembly shown in FIG. 3 and illustrating two flexible, electrically-insulative sleeves that may be disposed over the end portions of braided lead wires joined to the coiled magnet wire during manufacture of the electromagnetic coil assembly.
Figure 5:
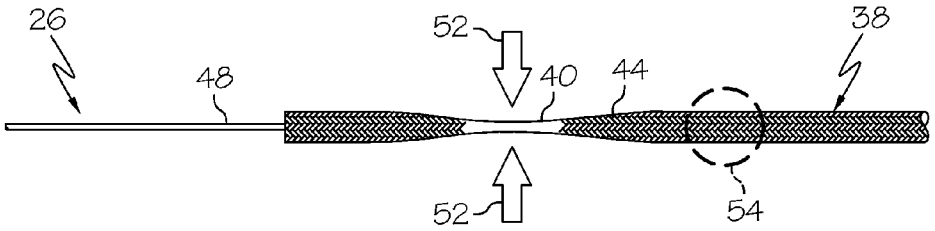
FIG. 5 is a side view of an exemplary crimp and/or solder joint that may be formed between an end portion of the coiled magnet wire and an end portion of the braided lead wire shown in FIG. 3.

In embodiment wherein braided lead wires 36 and 38 are fabricated from aluminum, additional improvements in breakdown voltage of electromagnetic coil assembly 10 (FIGS. 1-4) can be realized by anodizing aluminum braided lead wires 36 and 38 prior to joining to opposing ends of coiled magnet wire 26 (FIGS. 2-4). In one option, braided lead wires 36 and 38 are produced by interweaving a plurality of pre-anodized aluminum strands, in which case the outer alumina shell covering the terminal end portions of the braided lead wires may be removed after weaving and cutting the braids to desired lengths utilizing, for example, a caustic etch of the type described below. However, producing braided lead wires 36 and 38 by interweaving a number of pre-anodized aluminum strands is generally undesirable in view of the hardness of the alumina shells, which tends to cause excessive wear to the winding machinery utilized in the production of braided wires. For this reason, braided lead wires 36 and 38 may be formed by first interweaving a plurality of non-anodized aluminum filaments or strands into an elongated master braid, cutting the elongated master braid into braid bundles of desired lengths, and then anodizing the braid bundles. The braid bundles can be anodized utilizing, for example, a reel-to-reel process similar to that utilized in anodization of individual wires. Alternatively, as the braided lead wires will typically be only a few inches in length, the anodization can be carried-out by racking short lengths of wire utilizing a specialized fixture and then submerging the rack in an anodization tank.

Figure 6:
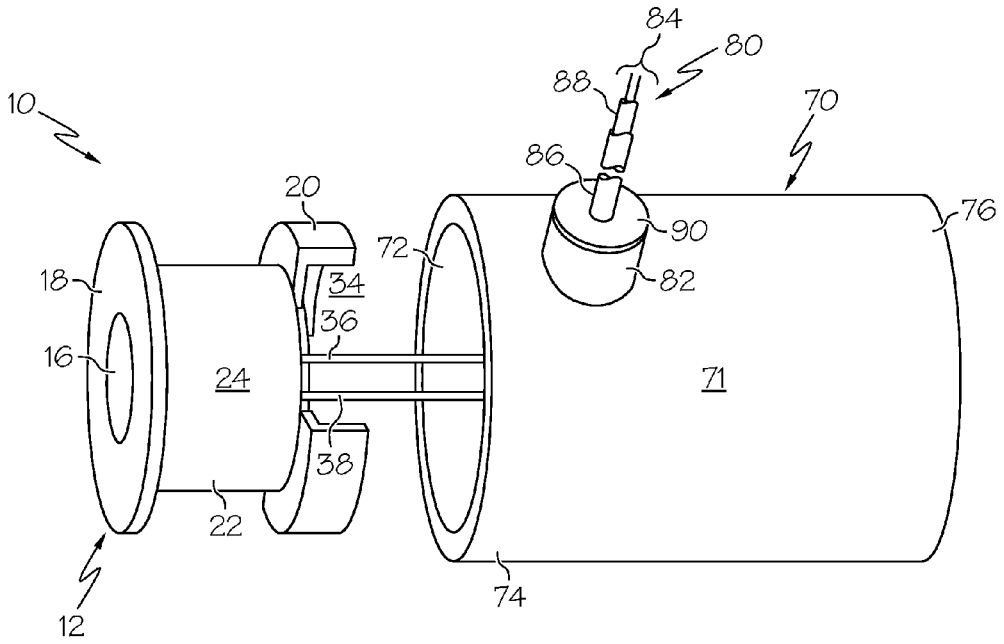
FIGS. 6 and 7 are simplified isometric views illustrating one manner in which the electromagnetic coil assembly shown in FIGS. 1 and 2 may be sealed within a canister in certain embodiments wherein the coil assembly is utilized within high temperature environments.

After connection of coiled magnet wire 26 to braided lead wires 36 and 38, and after formation of electrically-insulative body 24 (FIG. 1) encapsulating coiled magnet wire 26, potted electromagnetic coil 22 and bobbin 12 may optionally be installed within a sealed housing or canister. Further illustrating this point, FIG. 6 is an isometric view of an exemplary coil assembly housing 70 including a canister 71, which has a cavity 72 into which bobbin 12 and the potted coil 22 may be installed (electrically-insulative sleeves 56 and 57 not shown). In the exemplary embodiment shown in FIG. 6, canister 71 assumes the form of a generally tubular casing having an open end 74 and an opposing closed end 76. The cavity of housing 70, and specifically of canister 71, may be generally conformal with the geometry and dimensions of bobbin 12 such that, when fully inserted into housing 70, the trailing flange of bobbin 12 effectively plugs or covers open end 74 of housing 70, as described below in conjunction with FIG. 7. At least one external feedthrough connector extends through a wall of housing 70 to enable electrical connection to potted coil 22 while bridging the hermetically-sealed environment within housing 70. For example, as shown in FIG. 6, a feedthrough connector 80 (only partially shown in FIG. 6) may extend into a tubular chimney structure 82 mounted through the annular sidewall of canister 71. Braided lead wires 36 and 38 are electrically coupled to corresponding conductors included within feedthrough connector 80, whether directly or indirectly by way of one or more intervening conductors; e.g., braided lead wires 36 and 38 may be electrically connected (e.g., crimped) to the electrical conductors of an interconnect structure, which are, in turn, electrically connected (e.g., brazed) to the wires of feedthrough connector 80, as described more fully below. Although not shown in FIG. 6 for clarity, braided lead wires 36 and 38 may be gently wrapped or loosely spiral wind around the outer circumference of dielectric body 24 depending upon the particular location at which the braided lead wires emerge from body 24.

Figure 7:
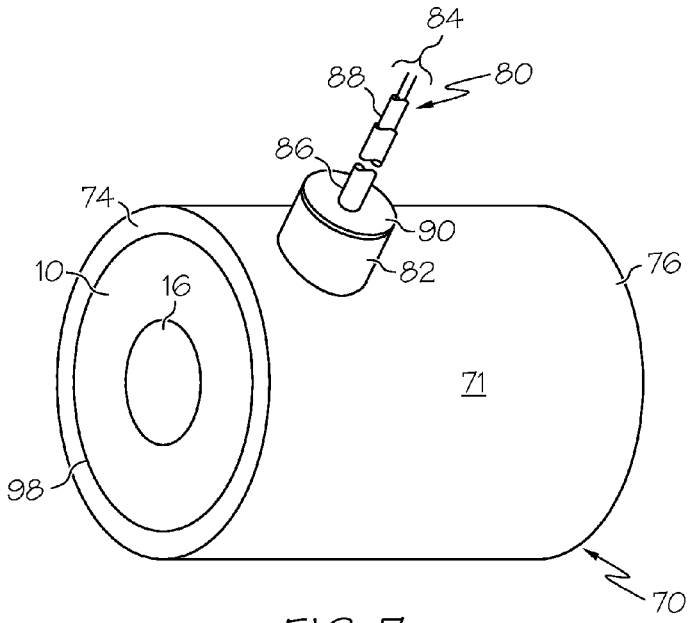

FIG. 7 is an isometric view of electromagnetic coil assembly 10 in a fully assembled state. As can be seen, bobbin 12 and potted coil 22 (identified in FIGS. 1-3 and 5) have been fully inserted into coil assembly housing 70 such that the trailing flange of bobbin 12 has effectively plugged or covered open end 74 of housing 70. In certain embodiments, the empty space within housing 70 may be filled or potted after insertion of bobbin 12 and potted coil 22 (FIGS. 1-3 and 5) with a suitable potting material. Suitable potting materials include, but are by no means limited to, high temperature silicone sealants (e.g., ceramic silicones), inorganic cements of the type described above, and dry ceramic powders (e.g., alumina or zirconia powders). In the case wherein potted coil 22 is further potted within housing 70 utilizing a powder or other such filler material, vibration may be utilized to complete filling of any voids present in the canister with the powder filler. In certain embodiments, potted coil 22 may be inserted into housing 70, the free space within housing 70 may then be filled with a potting powder or powders, and then a small amount of dilute cement may be added to loosely bind the powder within housing 70. A circumferential weld or seal 98 has been formed along the annular interface defined by the trailing flange of bobbin 12 and open end 74 of coil assembly housing 70 to hermetically seal housing 70 and thus complete assembly of electromagnetic coil assembly 10. The foregoing example notwithstanding, it is emphasized that various other methods and means can be utilized to hermetically enclose the canister or housing in which the electromagnetic coil assembly is installed; e.g., for example, a separate end plate or cap may be welded over the canister's open end after insertion of the electromagnetic coil assembly. More generally, it is noted that electromagnetic coil assembly 10 need not be sealed within a hermetic or water-tight housing in all embodiments.

After assembly in the above described manner, electromagnetic coil assembly 10 may be integrated into a coiled-wire device, such as an actuator, sensor, or motor. In the illustrated example wherein electromagnetic coil assembly 10 includes a single wire coil, assembly 10 may be included within a solenoid. In alternative embodiments wherein electromagnetic coil assembly 10 is fabricated to include primary and secondary wire coils, assembly 10 may be integrated into a linear variable differential transducer or other sensor. In embodiments wherein potted electrically-insulative body 24 is substantially devoid of inorganic materials and sealed within a hermetic housing, electromagnetic coil assembly 10 is well-suited for usage within avionic applications and other high temperature applications. The exemplary embodiment shown in FIGS. 6 and 7 notwithstanding, it is emphasized that the electromagnetic coil assembly need not include a housing or container in all embodiments and, in certain embodiments, may instead be a freestanding coil assembly.

Feedthrough connector 80 can assume the form of any assembly or device, which enables two or more wires, pins, or other electrical conductors to extend from a point external to coil assembly housing 70 to a point internal to housing 70 without compromising the sealed environment thereof. For example, feedthrough connector 80 can comprise a plurality of electrically-conductive pins, which extend through a glass body, a ceramic body, or other electrically-insulative structure mounted through housing 70. Alternatively, feedthrough connector 80 can assume the form of a mineral-insulated cable containing two or more wires that extend within a tube packed with a dielectric powder. Additional description of devices suitable for usage as feedthrough connector 80, and different manners in which the lead wires can be joined to the wires, pins, or other electrically-conductive members of the feedthrough connector, can be found in the following co-pending applications, each of which is assigned to the assignee of the Instant Application and is incorporated by reference: U.S. application Ser. No. 13/460,446, entitled "HIGH TEMPERATURE ELECTROMAGNETIC COIL ASSEMBLIES AND METHODS FOR THE PRODUCTION THEREOF," and filed Apr. 30, 2012; and U.S. application Ser. No. 13/460,460, entitled "HIGH TEMPERATURE ELECTROMAGNETIC COIL ASSEMBLIES INCLUDING BRAIDED LEAD WIRES AND METHODS FOR THE FABRICATION THEREOF," and also filed Apr. 30, 2012.

Figure 8:
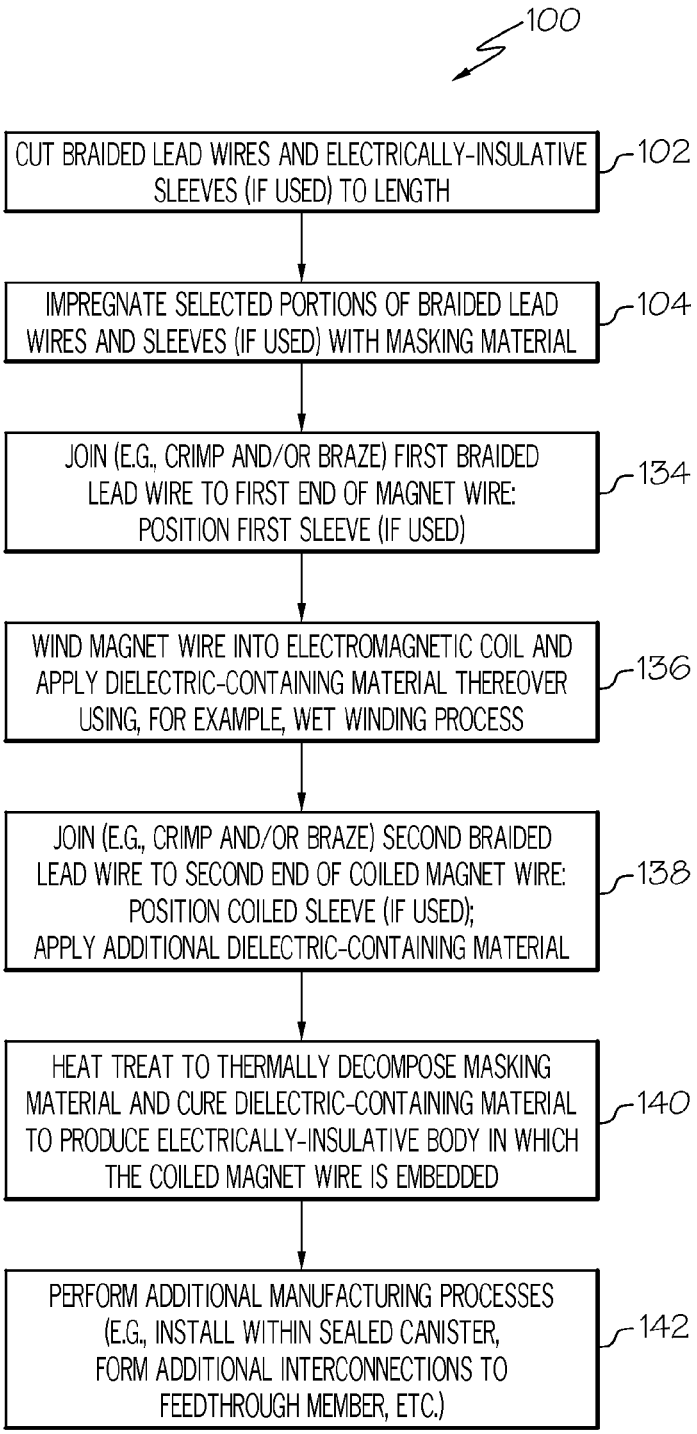
FIG. 8 is a flowchart illustrating an exemplary method for fabricating an electromagnetic coil assembly, such as the electromagnetic coil assembly shown in FIGS. 1-7, wherein the braided lead wires and/or the electrically-insulative braided sleeves, if present, are infiltrated with a masking material prior to the wet-state application of the dielectric-containing material to preserve the pliability of the lead wires and/or sleeves through the remainder of the fabrication process.

FIG. 8 is an exemplary method 100 for fabricating an electromagnetic coil assembly, such as electromagnetic coil assembly 10 shown in FIGS. 1-7, wherein selected portions of one or more braided lead wires and/or electrically-insulative braided sleeves are infiltrated with a masking material prior to application of the wet-state, dielectric-containing material to preserve the pliability of the lead wires and/or sleeves through the remainder of the fabrication process. For convenience of explanation, method 100 will be described below in conjunction with exemplary coil assembly 10 shown in FIGS. 1-7; it will be appreciated, however, that method 100 can be utilized to fabricate electromagnetic coil assemblies having different structure features. For example, while described below as including both braided lead wires and braided electrically-insulative sleeves, it will be appreciated that exemplary method 100 can also be utilized to produce electromagnetic coil assemblies including woven lead wires and lacking woven sleeves or, conversely, electromagnetic coil assemblies including non-woven or single stranded lead wires and braided electrically-insulative sleeves. The steps illustrated in FIG. 8 and described below are provided by way of example only; and that in alternative embodiments of method 100, additional steps may be performed, certain steps may be omitted, and/or the steps may be performed in alternative sequences.

Exemplary method 100 commences with cutting the braided lead wires (e.g., lead wires 36 and 38 shown in FIGS. 1-6) and electrically-insulative braided sleeves (e.g., sleeves 56 and 57 shown in FIG. 4) to predetermined lengths (STEP 102, FIG. 8). The lengths to which the braided lead wires and the electrically-insulative sleeves, if included, are cut will inevitably vary amongst different embodiments in conjunction with a variety of factors, such as the dimensions of the electromagnetic coil assembly, the distance between the coiled magnet wire and the interconnect, and the amount of excess length desired to facilitate formation of the wire-to-lead joints and packaging of potted electromagnetic coil 22. In the illustrated example shown in FIGS. 1-7, and as may be most easily appreciated by referring briefly to FIG. 2, braided lead wire 36 ("the bottom lead") is joined to the end portion of coiled magnet wire 26 located closer to the centerline of electromagnetic coil assembly 10 and closer to the feed-out end of bobbin 12, while braided lead wire 38 ("the top lead") is joined to the end portion of coiled magnet wire 26 located further from the centerline of electromagnetic coil assembly 10 and further from the feed-out end of bobbin 12; consequently, braided lead wire 36 will typically be cut to have a length less than that of braided lead wire 38. Electrically-insulative braided sleeves 56 and 57 will typically only cover the portions of wires 36 and 38, respectively, extending into dielectric body 24 (FIGS. 1-4 and 6), along with a small portion of the external segments of wires 36 and 38 projecting from dielectric body 24. Consequently, braided sleeves 56 and 57 may be cut to a length less than braided lead wires 36 and 38, respectively.

Figure 9:
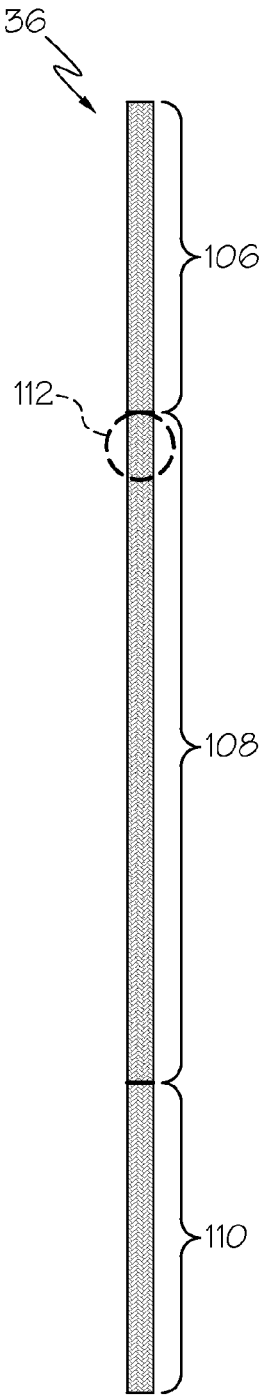
FIGS. 9-12 collectively illustrate one exemplary manner in which a masking material may be applied to selected portions of a braided lead wire and an electrically-insulative braided sleeve, such as either or both of the braided lead leads wires shown in FIGS. 1-6 and/or the electrically-insulative braided sleeves shown in FIG. 4.

Next, at STEP 104 of exemplary method 100 (FIG. 8), braided lead wires 36 and 38 and/or electrically-insulative braided sleeves 56 and 57 are impregnated or infiltrated with a chosen masking material. The masking material impregnated into braided lead wires 36 and 38 and/or electrically-insulative braided sleeves 56 and 57 can be any substance capable of preventing or at least deterring the undesired wicking of the dielectric-containing material. A non-exhaustive list of materials suitable for usage as the dielectric-containing material is set-forth below. FIG. 9 illustrates braided lead wire 36 after the selective application of masking material during STEP 104 of exemplary method 100 (FIG. 8). As identified in FIG. 9, braided lead wire 36 includes a first end portion 106, an intermediate portion 108, and a second end portion 110. During fabrication of electromagnetic coil assembly 10 (FIGS. 1-7), the dielectric-containing material is applied in a wet-state over coiled magnet wire 26 (FIGS. 2-4) and over first end portion 106 of braided lead wire 36. As previously described, the dielectric-containing material is then cured to produce a solid-state, electrically-insulative body 24 in which coiled magnet wire 26 is at least partially embedded. End portion 106 of braided lead wire 36 is joined to coiled magnet wire 26 and is likewise embedded within electrically-insulative body 24, while intermediate portion 108 extends therefrom. The demarcation between end portion 106 and intermediate portion 108 of braided lead wire 36 thus generally corresponds to the braided lead wire's entry point into/exit point from electrically-insulative body 24.

As previously stated, it is desired to prevent the pre-cure wicking of the wet-state, dielectric-containing material into intermediate segment 108 of braided lead wire 36 due to capillary action to preserve the flexibility or pliability of intermediate segment 108 through the curing process. Conversely, it is desirable to impregnate end segment 106 of braided lead wire 36, at least in part, with the dielectric-containing material to prevent undesired voiding in the electrically-insulative body 24 produced pursuant to curing, which could otherwise increase the susceptibility of body 24 to fracture or other structural damage when subjected to shock or significant vibratory loads. Thus, as generically indicated in FIG. 9 by dashed circle 112, a sufficient quantity of masking material may be selectively applied to a region of intermediate portion 108 and adjacent end portion 106 to serve as a dam or blockage against the wicking of the dielectric-containing material into intermediate portion 108. Such selective application of the masking material may be carried-out utilizing, for example, a brush, pad, or syringe. This notwithstanding, it may be more convenient or expedient to impregnate a relatively lengthy intermediate portion of each braided lead wires 36 and 38 and/or braided sleeves 56 and 57 utilizing, for example, a dipping process in which intermediate portion 108 is impregnated with masking material in its substantial entirety, as described below in conjunction with FIG. 10.

Figure 10:
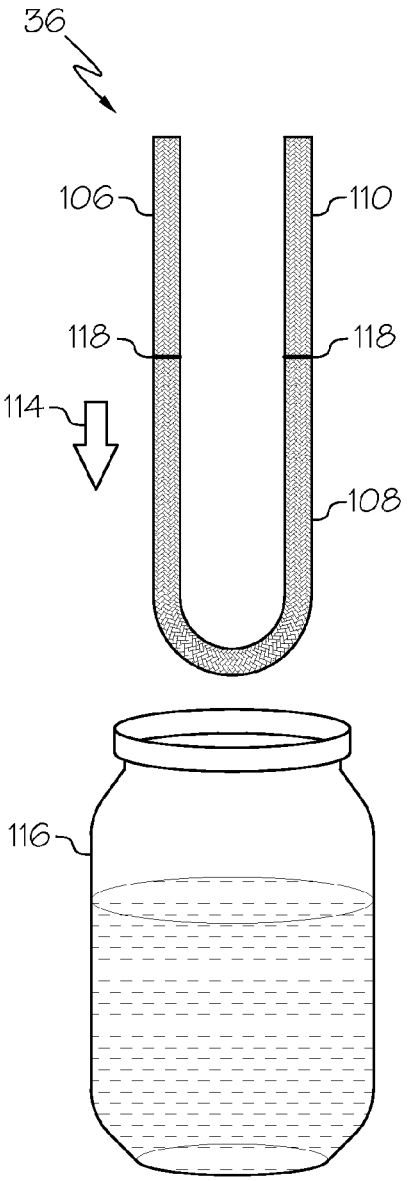

FIG. 10 illustrates a dipping process during which braided lead wire 36 is bent into a loop with intermediate portion 108 forming the bottom portion of the loop. As indicated in FIG. 10 by arrow 114, the bottom of the loop may then be dipped in a container 116 holding the masking material for a sufficient period of time to allow complete penetration of intermediate portion 108. In this case, the masking material may be produced by, for example, dissolving acrylic beads in a solvent (e.g., alpha terpineol) and then diluting the resulting solution (e.g., with an alcohol, such as 2-proponal) to achieve a desired viscosity. In one embodiment, the masking material solution comprises about 60 weight percent ("wt. %") acrylic dissolved in alpha terpineol and about 40 wt. % 2-propanlol. For reasons explained more fully below, a water insoluble acrylic polymer is preferably utilized, such Poly (Ethyl Methacrylate) in embodiments wherein the dielectric-containing material is a water-activated cement or another material containing water.

The above-described dipping process results in the impregnation of intermediate portion 108 of braided lead wire 36 with masking material, while leaving opposing terminal end portions 106 and 110 of braided lead wire 36 unmasked; that is, not impregnated or infiltrated by the masking material. With respect to end portion 110 of braided lead wire 36, in particular, this prevents the masking material from interfering with the crimping or other joinder of end portion 110 to another electrically-conductive member, such as the pins or wires of feedthrough connector 80 (FIGS. 6 and 7). Markers 118 are conveniently created on braided lead wire 36 (e.g., by marking with ink or paint) to indicate the depth to which lead wire 36 should be submerged within the liquid masking material to ensure impregnation of intermediate portion 108, while leaving end portions 106 and 110 unmasked. A similar process can also be carried-out to selectively impregnate the intermediate portion of braided lead wire 38 (FIGS. 1-4 and 6). Although FIG. 10 illustrates the dipping of a single braided lead wire into a relatively small container of masking material, it will be appreciated that such a dipping process can be performed on a larger scale by dipping several dozen or several hundred braided lead wires into a vat of masking material to improve efficiency in further embodiments. After application, any excess masking material may be removed by, for example, dabbing with a cloth or towel; and the selectively-masked lead wires may be hung on a rack in an open air environment and/or in a heated drying oven for a time period sufficient to allow the applied masking material to dry.

Figure 11:
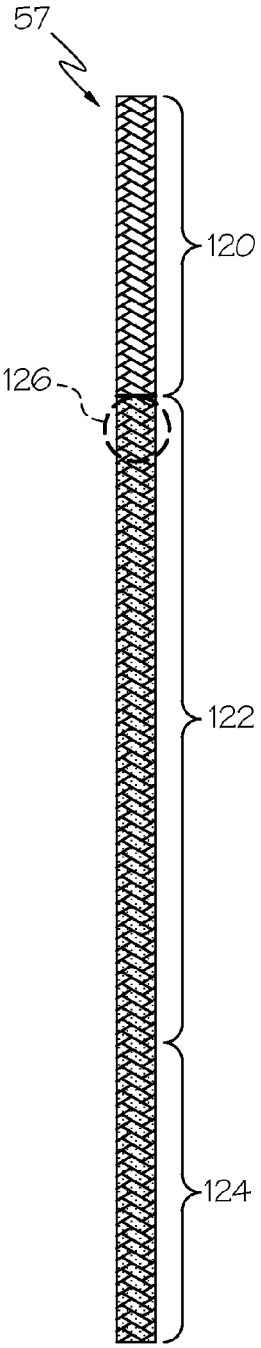
Figure 12:
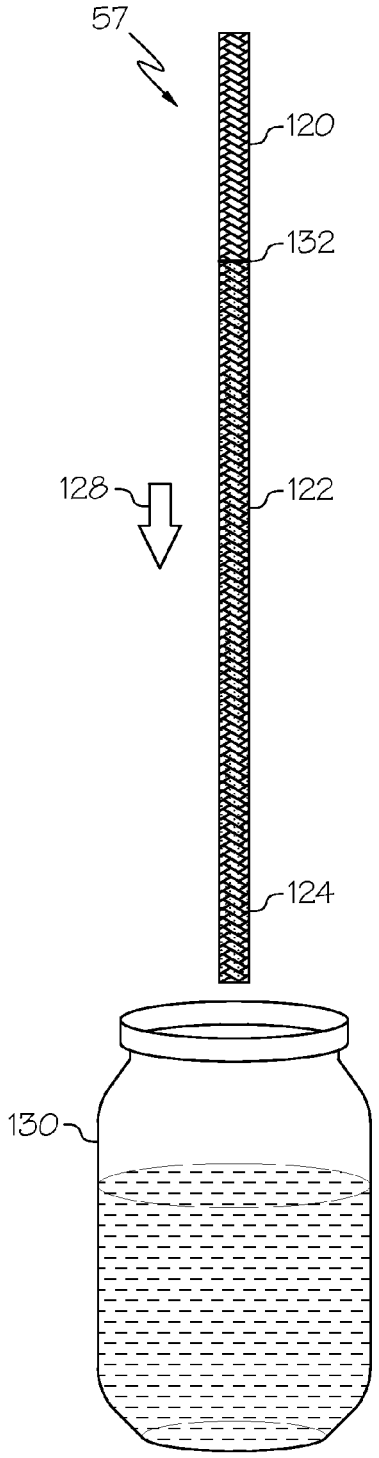

As was the case with braided lead wires 36 and 38, it is desirable to prevent wicking of the masking material from the terminal end portions of the braided sleeves extending into electrically-insulative body 24 (FIGS. 1-4 and 6) and contacted by the dielectric-containing material during the wet-state application thereof, into the intermediate or external portions of the sleeves extending outwardly from body 25. A similar masking process can thus be utilized to selectively impregnate electrically-insulative braided sleeves 56 and 57 with the masking material. In particular, masking material may be selectively applied to region 120 to provide a dam against wicking of the masking material into intermediate portion 122 of sleeve 56, as indicated in FIG. 11. Alternatively, this can be accomplished utilizing a dipping process. For example, as indicated in FIG. 12 by arrow 122, braided sleeve 57 can be dipped into a container 130 holding the masking material solution. Again, a marker 126 (e.g., an ink or paint marking) may be created on braided sleeve 57 to indicate the appropriate insertion depth. However, as braided sleeve 57 will typically only extend part of the length of intermediate portion 108 of braided lead wire 36, there is no need to prevent masking of opposing terminal end portion 124. Thus, as shown in FIG. 12, braided sleeve 57 may be not be bend into a loop and instead both intermediate portion 122 and end portion 124 may be dipped into the liquid masking material.

As noted above, the masking material impregnated into braided lead wires 36 and 38 and/or electrically-insulative braided sleeves 56 and 57 can be any substance capable of preventing or at least deterring the undesired wicking of the dielectric-containing material. It is preferred, however, that the chosen masking material can be cleanly burned away or otherwise thermally decomposed at a relatively low processing temperatures in embodiments wherein the electromagnetic coil assembly is utilized within a high temperature environment and the masking material, if not removed, could negatively impact device operation by, for example, charring and altering the desired insulation resistance. In this manner, the masking material can be removed by heating the impregnated portions of the braided lead wires and/or braided sleeves to a predetermined temperature at which the masking material decomposes, which will often be greater than about 260° Celsius and less than the melt point or softening point of the wound magnet wire. A non-exhaustive list of masking materials suitable for removal by thermal decomposition at relatively low temperatures include waxes, ethyl cellulose, high temperature silicones, polyvinyl alcohols, and acrylics. Thermal decomposition of the masking material may be accomplished in concert with the curing process carried-out during STEP 140 of exemplary method 100, as described below. The foregoing examples notwithstanding, the masking material may be removed utilized other means (e.g., treatment with a chemical solvent) in alternative embodiments; or removal of the masking material may be unnecessary in certain embodiments, such as when the electromagnetic coil assembly is utilized within a low temperature environment.

In addition to being able to be removed by thermal decomposition at a relatively low temperature, it is also preferred that the dielectric is substantially insoluble in the dielectric-containing material. In this manner, dissolution of the masking material into the dielectric-containing material can be prevented, which could otherwise remove the masking material from the regions of the braided lead wires and/or braided sleeves to which the masking material has been applied and which could also detract from the strength of the electrically-insulative body produced by curing the dielectric-containing material. Thus, in embodiments wherein the dielectric-containing material is dissolved within or carried by water, such as when the dielectric-containing material is a water-activated cement mixed with water, it is preferred that the dielectric-containing material is substantially insoluble in water and, more preferably, that the masking material has a water solubility less than that of polyvinyl alcohol. Masking materials having such a low water solubility and that can be thermally decomposed at relatively low temperatures include certain acrylic polymers, such as Poly (Ethyl Methacrylate). Such acrylic polymers should be distinguished from water soluble acrylic polymers, including Poly (Methyl Methacrylate), Poly (Ethyl Acrylate), and Poly (Methacrylic Acid). Commercially available Poly (Ethyl Methacrylate) materials include Elvacite 2042® available from Lucite International, Inc.

After impregnation of the selected portions of the braided lead wires and/or braided sleeves (STEP 104), exemplary method 100 (FIG. 8) advances to STEP 134 wherein a terminal end portion of the first braided lead wire (e.g., braided lead wire 36 shown in FIGS. 1-4, 6, 9, and 10) is joined to an end portion of the coiled magnet wire (e.g., coiled magnet wire 26 shown in FIG. 2). As described in detail above, joinder of the first braided lead wire to the coiled magnet wire is preferably achieved by crimping and/or soldering. After joinder of the first braided lead wire and the coiled magnet wire, a first electrically-insulative sleeve (e.g., sleeve 57 shown in FIGS. 4, 11, and 12) can be positioned relative to the terminal end portion of the first braided lead wire and the wire-to-lead joint. The magnet wire may then be wound into one or more coils, and the dielectric-containing material may be applied in a wet-state over the wound magnet wire utilizing, for example, a wet winding process of the type described above (STEP 146, FIG. 8).

When applied over the wound magnet wire, the wet-state, dielectric-containing material contacts the terminal end portion of the first braided lead wire. When left unmasked, the terminal end portion of the first braided lead wire (e.g., end portion 106 of braided lead wire 36 shown in FIGS. 9 and 10) is infiltrated by the dielectric-containing material. However, the masking-material-impregnated portion of the braided lead wire prevents the undesired wicking of the masking material into the intermediate portion of braided lead wire extending from the electrically-insulative body (e.g., intermediate portion 108 of braided lead wire 36 shown in FIGS. 9 and 10). Similarly, in embodiments wherein an electrically-insulative braided sleeve is utilized and also contacted by the wet-state, dielectric-containing material, the impregnated portions of the braided sleeve prevent undesired migration of the masking material away from the coiled magnet wire and into the body of the sleeve; e.g., with reference to FIGS. 11 and 12, the masking material prevents undesired wicking of the dielectric containing material from terminal end portion 120 to intermediate end portion 122 of electrically-insulative sleeve 57. In further implementations of exemplary method 100, the electrically-insulative sleeves may be placed near their desired positions prior to formation of the wire-to-lead joint. For example, in certain cases, each tubular sleeve may be threaded over its respective lead wire and moved close to its desired position prior to formation of the wire-to-lead joint. After formation of the wire-to-lead joint, the tubular sleeve may then be fully slid into its proper position covering the newly-formed wire-to-lead joint.

After winding magnet wire 26 (FIG. 2) into one or more coils, the opposing end portion of magnet wire 26 is joined to the second braided lead wire (STEP 138, FIG. 8). Again, crimping, brazing/soldering, or twisting may be utilized to join magnet wire 26 to the second braided lead wire; and, if desired, a second electrically-insulative flexible sleeve may be positioned over the joint after formation thereof. Additional wet-state, dielectric-containing material may then be applied over the assembly during which the second lead wire (e.g., lead wire 38 shown in FIGS. 1-6) and the second sleeve (e.g., sleeve 56 shown in FIG. 4) may be contacted by the dielectric-containing material. However, as was the case previously with lead wire 36 and sleeve 57, the masking material impregnated into lead wire 38 and/or sleeve 56 prevents the undesired wicking or migration of the dielectric-containing material. Thus, as indicated in FIG. 8 at STEP 140, curing can be carried-out to produce electrically-insulative body 24 (FIGS. 1-4 and 6) from the dielectric-containing material, while the flexibility of lead wires 36 and 38 and/or sleeves 56 and 57 is maintained. Furthermore, curing may be performed under process conditions sufficient to thermally decompose the masking material from the braided lead wires and/or sleeves. In one embodiment, full curing of the dielectric-containing material and burnout of the masking material is performed by exposing electromagnetic coil assembly 10 (FIGS. 1-4, 6, and 7) to a highly elevated temperature (e.g., about 399° C.) for a predetermined time period (e.g., about 16 hours).

While it is preferred that the masking material is removed from the braided lead wires and/or braided sleeves utilizing a thermal decomposition process, it is emphasized that the masking material may be removed at any time subsequent to at least partial curing the dielectric-containing material and by any suitable means, including by treatment with a chemical solvent. In such embodiments, the particular chemical solvent utilized to remove the masking material will, of course, vary in conjunction with the chemical make-up of the chosen masking material. For example, in embodiments wherein the chosen masking material comprises Poly (Ethyl Methacrylate), removal of the masking material may be accomplished by contact with acetone, methyl ethyl ketone, toluene, ethyl acetate, or another suitable solvent. Furthermore, in certain embodiments, such as in embodiments wherein the electromagnetic coil assembly is intended for operation in low temperature environments characterized by temperatures less than 260° C., the masking material may not be removed. Finally, at STEP 142 (FIG. 8), additional steps are performed to complete manufacture of the electromagnetic coil assembly. For example, the electromagnetic coil assembly may optionally be sealed within a housing, such as canister 71 (FIGS. 6 and 7), and the housing may be potted with a dielectric material as described above; however, as previously indicated, exemplary method 100 can also be utilized to produce freestanding coil assemblies lacking a sealed or unsealed housing.

The foregoing has thus provided embodiments of an electromagnetic coil assembly wherein flexible, braided lead wires are joined to a coiled magnet wire partially or wholly embedded within a body of dielectric material to provide a convenient and robust electrical connection between an external circuit and the potted electromagnetic coil, while effectively protecting the magnet wire from mechanical stress during assembly that could otherwise fatigue and work harden the magnet wire. As braided lead wires are fabricated from multiple interwoven filaments, braided lead wires also provide redundancy and thus increase the overall reliability of the electromagnetic coil assembly. In preferred embodiments, selected portions of the braided lead wires are impregnated with a masking material prior to the wet-state application of a dielectric-containing material over coiled magnet wire to preserve the flexibility of the lead wires, which can otherwise become prone to breakage and limit product yields if subject to embrittlement due to the wicking and curing of the dielectric-containing material. The following also has provided embodiments of an electromagnetic coil assembly including braided electrically-insulative sleeves disposed over the lead wires, which may be braided or non-braided, and likewise impregnated with a masking material prior to the wet-state application of a dielectric-containing material to preserve the flexibility of the sleeves through the subsequent curing process and to maintain dielectric insulation between the underlying electrical conductor and adjacent conductors or conductive surfaces.

As noted above, the usage of flexible braided lead wires can be advantageous in certain low temperature applications wherein the coiled magnet wire is potted within a relatively rigid, organic dielectric, such as a hard plastic; however, the usage of such flexible braided lead wires is particularly advantageous in high temperature applications wherein highly rigid, inorganic materials are utilized, which are capable of maintaining their electrically-insulative properties at temperatures well-above the thresholds at which conventional, organic dielectrics breakdown and decompose. In such embodiments, the electromagnetic coil assembly is well-suited for usage in high temperature coiled-wire devices, such as those utilized in avionic applications. More specifically, and by way of non-limiting example, embodiments of the high temperature electromagnetic coil assembly are well-suited for usage within actuators (e.g., solenoids and motors) and position sensors (e.g., variable differential transformers and two position sensors) deployed onboard aircraft. This notwithstanding, it will be appreciated that embodiments of the electromagnetic coil assembly can be employed in any coiled-wire device, regardless of the particular form assumed by the coiled-wire device or the particular application in which the coiled-wire device is utilized.

The foregoing has also described embodiments of an electromagnetic coil assembly that includes a body of dielectric material and a coiled magnet wire, which is at least partially embedded in the body of dielectric material. The electromagnetic coil assembly further includes a braided lead wire having an end portion, which extends into the body of dielectric material and joined to the coiled magnet wire. An intermediate portion of the braided lead wire extends from, and is thus external to, the body of dielectric material. In preferred embodiments wherein masking material is applied to the braided lead wire and then removed therefrom by, for example, thermal decomposition the intermediate portion of the braided lead wire is substantially devoid of the dielectric material, while at least a portion of the end portion of the braided lead wire is infiltrated by the dielectric material. While the masking material is preferably chosen to burn away cleanly during the thermal decomposition process, trace amounts of residue of the masking material will often remain on the braided lead wire. Thus, in such cases, masking material residue will be present on the intermediate portion of the braided lead wire. In further embodiments, the masking material may not be removed; thus, in such cases, the finished electromagnetic coil assembly may include masking material impregnated into the intermediate segment of the braided lead wire.

While multiple exemplary embodiments have been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. An electromagnetic coil assembly, comprising:
- a body of dielectric material;
- a coiled magnet wire at least partially embedded in the body of dielectric material; and
- a braided lead wire, comprising:
  - an end portion extending into the body of dielectric material and joined to the coiled magnet wire; and
  - an intermediate portion external to the body of dielectric material, the intermediate portion of the braided lead wire devoid of the dielectric material, while at least a portion of the end portion of the braided lead wire is infiltrated by the dielectric material.

2. The electromagnetic coil assembly of claim 1 further comprising at least one of the group consisting of masking material and masking material residue present on the intermediate portion of the braided lead wire.

3. The electromagnetic coil assembly of claim 1 further comprising a masking material impregnated into the intermediate portion of the braided lead wire.

4. The electromagnetic coil assembly of claim 3 wherein the masking material is selected from the group consisting of waxes, ethyl cellulose, silicones, polyvinyl alcohols, and acrylics.

5. The electromagnetic coil assembly of claim 3 wherein the masking material comprises a water-insoluble acrylic polymer.

6. The electromagnetic coil assembly of claim 1 wherein the body of dielectric material comprises one of the group consisting of an inorganic dielectric cement and a low melt glass.

7. The electromagnetic coil assembly of claim 1 further comprising an electrically-insulative braided sleeve disposed over the braided lead wire and extending into the body of dielectric material.

8. The electromagnetic coil assembly of claim 7 wherein electrically-insulative braided sleeve comprises:
- a first portion extending into the body of dielectric material and at least partially infiltrated by the dielectric material; and
- a second portion extending from the body of dielectric material and substantially devoid of the dielectric material.

9. The electromagnetic coil assembly of claim 1 wherein the coiled magnet wire comprises anodized aluminum wire.

10. An electromagnetic coil assembly, comprising:
- a body of dielectric material;
- a coiled magnet wire at least partially embedded in the body of dielectric material;
- a lead wire extending into the body of dielectric material and joined to the coiled magnet wire; and
- a braided sleeve disposed over the lead wire, the braided sleeve comprising:
  - an end portion extending into the body of dielectric material; and
  - an intermediate portion external to the body of dielectric material, the intermediate portion of the braided sleeve devoid of the dielectric material, while at least a portion of the end portion of the braided sleeve is infiltrated by the dielectric material.

11. The electromagnetic coil assembly of claim 10 wherein the braided sleeve comprises a woven fiberglass tube.

12. The electromagnetic coil assembly of claim 10 wherein the lead wire comprises a braided lead wire having a terminal end portion buried within the body of dielectric material and having an intermediate portion external to the body of dielectric material.

13. The electromagnetic coil assembly of claim 12 further comprising a masking material impregnated into the intermediate portion of the braided sleeve and into the intermediate portion of the braided lead wire.

14. The electromagnetic coil assembly of claim 10 further comprising at least one of the group consisting of masking material and masking material residue present on the intermediate portion of the braided sleeve.

15. The electromagnetic coil assembly of claim 10 further comprising a masking material infiltrated into the intermediate portion of the braided sleeve.

16. An electromagnetic coil assembly, comprising:

a potted electromagnetic coil containing a coiled magnet wire;

a braided lead wire joined to the coiled magnet wire and extending from the potted electromagnetic coil at an exit point; and one of the group consisting of masking material and masking material residue present on the braided lead wire at a location external to the potted electromagnetic coil and adjacent the exit point.

17. The electromagnetic coil assembly of claim 16 wherein the potted electromagnetic coil further comprises a body of dielectric material formed around the coiled magnet wire by applying a dielectric material to the coiled magnet wire in wet state and then curing the dielectric material.

18. The electromagnetic coil assembly of claim 17 comprising masking material residue present on the braided lead wire at a location external to the potted electromagnetic coil and adjacent the exit point, the masking material residue comprising the remains of a masking material thermally decomposed from the braided lead wire after formation of the body of dielectric material.

19. The electromagnetic coil assembly of claim 17 wherein the electromagnetic coil assembly comprises a masking material infiltrated into the braided lead wire, the masking material deterring wicking of the dielectric material into an intermediate portion of the coiled magnet wire during wet state application of the dielectric material.

20. The electromagnetic coil assembly of claim 17 wherein the braided lead wire comprises:

a penetrating end portion adjacent the exit point, buried within the body of dielectric material, and impregnated with the dielectric material; and an intermediate portion adjacent the exit point, external to the body of dielectric material, and substantially devoid of the dielectric material.

* * * * *